US005899968A

United States Patent [19]

Navarro et al.

[11] Patent Number: 5,899,968

[45] Date of Patent: May 4, 1999

[54] SPEECH CODING METHOD USING SYNTHESIS ANALYSIS USING ITERATIVE CALCULATION OF EXCITATION WEIGHTS

[75] Inventors: William Navarro, Velizy-Villacoublay; Michel Mauc, Leuville-sur-Orge, both of France

[73] Assignee: Matra Corporation, Quimper, France

[21] Appl. No.: 08/860,799

[22] PCT Filed: Jan. 3, 1996

[86] PCT No.: PCT/FR96/00005

§ 371 Date: Oct. 14, 1997

§ 102(e) Date: Oct. 14, 1997

[87] PCT Pub. No.: WO96/21219

PCT Pub. Date: Jul. 11, 1996

[30] Foreign Application Priority Data

Jan. 6, 1995 [FR] France ..... 95 00124

[51] Int. Cl.[6] ..... G10L 9/14

[52] U.S. Cl. ..... 704/220; 704/225; 704/223

[58] Field of Search ..... 704/219, 220, 704/221, 222, 225, 223

[56] References Cited

U.S. PATENT DOCUMENTS

| | | |
|---|---|---|
| 4,802,171 | 1/1989 | Rasky . |
| 4,831,624 | 5/1989 | McLaughlin et al. . |
| 4,964,169 | 10/1990 | Ono . |
| 5,060,269 | 10/1991 | Zinser . |
| 5,097,507 | 3/1992 | Zinser et al. . |
| 5,253,269 | 10/1993 | Gerson et al. . |
| 5,265,219 | 11/1993 | Gerson et al. . |

FOREIGN PATENT DOCUMENTS

| | | |
|---|---|---|
| 0137532 | 4/1985 | European Pat. Off. . |
| 0195487 | 9/1986 | European Pat. Off. . |
| 0307122 | 3/1989 | European Pat. Off. . |
| 0397628 | 11/1990 | European Pat. Off. . |
| 0415163 | 3/1991 | European Pat. Off. . |
| 0515138 | 11/1992 | European Pat. Off. . |
| 0573398 | 12/1993 | European Pat. Off. . |
| 0619574 | 10/1994 | European Pat. Off. . |
| 2238933 | 6/1991 | United Kingdom . |
| 2268377 | 1/1994 | United Kingdom . |
| WO 88/09967 | 12/1988 | WIPO . |
| WO 91/03790 | 3/1991 | WIPO . |
| WO 91/06093 | 5/1991 | WIPO . |
| WO 93/05502 | 3/1993 | WIPO . |
| WO 93/15502 | 8/1993 | WIPO . |

OTHER PUBLICATIONS

Database INSPEC, Institute of Elect. Engineers, Stevenage, GB, Inspec No. 4917063 A. Kataoka et al, "Implementation and performance of an 8–kbit/s conjugate structure speech coder", Abstract.

IEEE Trans. on Acoustics, Speech and Signal Processing, vol. 37, No. 3, Mar. 1989, pp. 317–327, S. Singhal et al, "Amplitude Optimization and Pitch Prediction in Multipulse Coders".

*Primary Examiner*—David R. Hudspeth
*Assistant Examiner*—Harold Zintel
*Attorney, Agent, or Firm*—Kilpatrick Stockton LLP

[57] ABSTRACT

A linear prediction analysis is performed for each frame of a speech signal to determine the coefficients of a short-Term synthesis filter. For each sub-frame, an excitations sequence which, when applied to the short-term synthesis filter generates a synthetic signal representative of the speech signal, is determined by means of an iterative process in which a symmetrical matrix $B_n$, is gradually built up with each iteration. The matrix $B_n$ is reversed with each iteration by decomposing the pattern $B_n=L_n \cdot R_n^T$ with $L_n=R_n \cdot K_n$ where $L_n$ and $R_n$ are triangular matrices and $K_n$ is a diagonal matrix, and matrix $L_n$ has only 1s on its main diagonal.

24 Claims, 9 Drawing Sheets

SPEECH CODING METHOD USING SYNTHESIS ANALYSIS USING ITERATIVE CALCULATION OF EXCITATION WEIGHTS

BACKGROUND OF THE INVENTION

The present invention relates to analysis-by-synthesis speech coding.

The applicant company has particularly described such speech coders, which it has developed, in its European patent applications 0 195 487, 0 347 307 and 0 469 997.

In an analysis-by-synthesis speech coder, linear prediction of the speech signal is performed in order to obtain the coefficients of a short-term synthesis filter modelling the transfer function of the vocal tract. These coefficients are passed to the decoder, as well as parameters characterising an excitation to be applied to the short-term synthesis filter. In the majority of present-day coders, the longer-term correlations of the speech signal are also sought in order to characterise a long-term synthesis filter taking account of the pitch of the speech. When the signal is voiced, the excitation in fact includes a predictable component which can be represented by the past excitation, delayed by TP samples of the speech signal and subjected to a gain $g_p$. The long-term synthesis filter, also reconstituted at the decoder, then has a transfer function of the form $1/B(z)$ with $B(z)=1-g_p \cdot z^{-TP}$. The remaining, unpredictable part of the excitation is called stochastic excitation. In the coders known as CELP ("Code Excited Linear Prediction") coders, the stochastic excitation consists of a vector looked up in a predetermined dictionary. In the coders known as MPLPC ("Multi-Pulse Linear Prediction Coding") coders, the stochastic excitation includes a certain number of pulses the positions of which are sought by the coder. In general, CELP coders are preferred for low data transmission rates, but they are more complex to implement than MPLPC coders.

One purpose of the present invention is to propose a method of speech coding in which the search for the stochastic excitation is simplified.

SUMMARY OF THE INVENTION

The invention thus proposes an analysis-by-synthesis speech coding method for coding a speech signal digitised into successive frames which are divided into sub-frames of 1st samples, in which a linear prediction analysis is performed for each frame in order to determine the coefficients of a short-term synthesis filter, and an excitation sequence is determined, for each sub-frame, with nc contributions each associated with a respective gain in such a way that the excitation sequence submitted to the short-term synthesis filter produces a synthetic signal representative of the speech signal, the nc contributions of the excitation sequence and the associated gains being determined by an iterative process in which the iteration n ($0 \leqq n < nc$) comprises:

determining the contribution n which maximises the quantity $(F_p \cdot e_{n-1}^T)^2/F_p \cdot F_p^T)$, where $F_p$ designates a row vector with 1st components equal to the products of convolution between one possible value of the contribution n and the impulse response of a composite filter consisting of the short-term synthesis filter and of a perceptual weighting filter, and $e_{n-1}$, designates a target vector determined during the iteration n−1 if $n \geqq 1$ and $e_{-1}=x$ is an initial target vector; and calculating n+1 gains forming a row vector $g_n=(g_n(0), \ldots, g_n(n))$ by solving the linear system $g_n \cdot B_n = b_n$ where $B_n$ is a symmetric matrix with n+1 rows and n+1 columns in which the component $B_n(i,j)$ ($0 \leqq i, j \leqq n$) is equal to the scalar product $F_{p(i)} \cdot F_{p(j)}^T$ where $F_{p(i)}$ and $F_{p(j)}$ respectively designate the row vectors equal to the products of convolution between the previously determined contributions i and j and the impulse response of the composite filter, and $b_n$ is a row vector with n+1 components $b_n(i)$ ($0 \leqq i \leqq n$) respectively equal to the scalar products between the vectors $F_{p(i)}$ and the initial target vector X, the nc gains associated with the nc contributions of the excitation sequence being those calculated during iteration nc−1. At each iteration n ($0 \leqq n < nc$), the rows n of three matrices L, R and K with nc rows and nc columns are calculated, such that $B_n = L_n \cdot R_n^T$ and $L_n = R_n \cdot K_n$ where $L_n$, $R_n$ and $K_n$ designate matrices with n+1 rows and n+1 columns corresponding respectively to the first n+1 rows and to the first n+1 columns of said matrices L, R and K, the matrices L and R being lower triangular matrices, the matrix K being diagonal, and the matrix L having only 1's on its main diagonal, the row n of the matrix $L^{-1}$, i.e. the inverse of the matrix L, is calculated, and the n+1 gains are calculated according to the relation $g_n = b_n \cdot K_n \cdot (L_n^{-1})^T \cdot L_n^{-1}$ where $L_n^{-1}$ designates the matrix with n+1 rows and n+1 columns corresponding respectively to the first n+1 rows and to the first n+1 columns of the inverse matrix $L^{-1}$.

This method of searching for the excitation limits the complexity of the calculations required to determine the excitation sequence, making it possible to carry out only one division or inversion at most per iteration. In the case of an MPLPC coder, the contributions may be pulsed contributions. This method of searching for the excitation is not applicable exclusively to MPLPC coders, however. It is applicable, for example, to the coders known as VSELP coders in which the contributions to the stochastic excitation are vectors chosen from a predetermined dictionary (see I. Gerson and M. Jasiuk: "Vector Sum Excited Linear Prediction (VSELP) Speech Coding at 8 kb/s", Proc. Int. Conf. on Acoustics, Speech and Signal Processing, Albuquerque 1990, Vol. 1, pages 461–464). Moreover, the nc contributions may comprise the contribution corresponding to the past excitation delayed by TP samples, the associated gain $g_p$ of which is recalculated during successive iterations, or several contributions of this nature if several delays LTP are determined.

DESCRIPTION OF PREFERRED EMBODIMENTS

Figure 1:
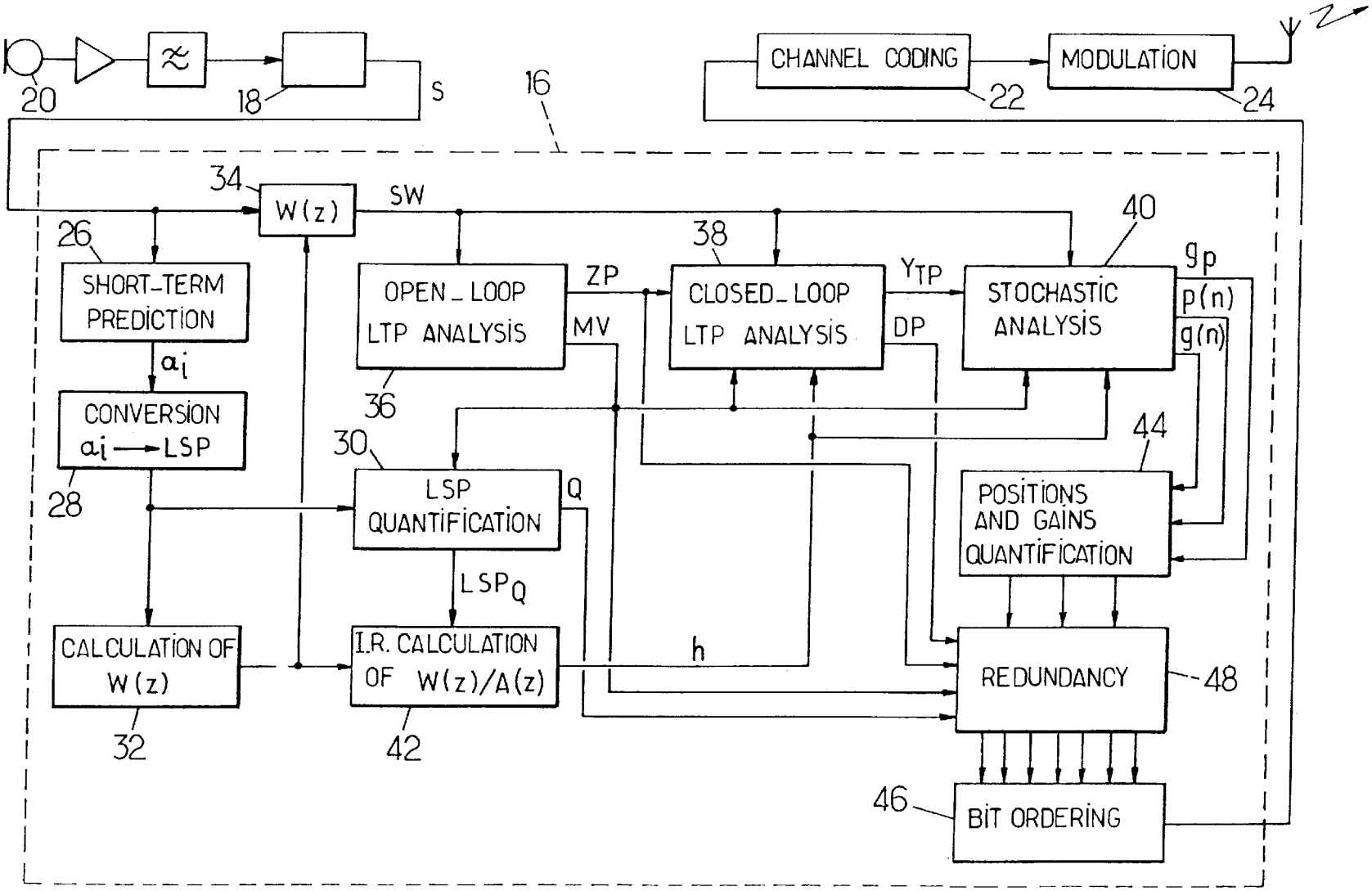
FIG. 1 is a block diagram of a radio communications station incorporating a speech coder implementing the invention.

A speech coder implementing the invention is applicable in various types of speech transmission and/or storage systems relying on a digital compression technique. In the example of FIG. 1, the speech coder 16 forms part of a mobile radio communications station. The speech signal S is a digital signal sampled at a frequency typically equal to 8 kHz. The signal S is output by an analogue-digital converter 18 receiving the amplified and filtered output signal from a microphone 20. The converter 18 puts the speech signal S into the form of successive frames which are themselves subdivided into nst sub-frames of 1st samples. A 20 ms frame typically includes nst=4 sub-frames of 1st=40 samples of 16 bits at 8 kHz. Upstream of the coder 16, the speech signal S may also be subjected to conventional shaping processes such as Hamming filtering. The speech coder 16 delivers a binary sequence with a data rate substantially lower than that of the speech signal S, and applies this sequence to a channel coder 22, the function of which is to introduce redundancy bits into the signal so as to permit detection and/or correction of any transmission errors. The output signal from the channel coder 22 is then modulated onto a carrier frequency by the modulator 24, and the modulated signal is transmitted on the air interface.

The speech coder 16 is an analysis-by-synthesis coder. The coder 16, on the one hand, determines parameters characterising a short-term synthesis filter modelling the speaker's vocal tract, and, on the other hand, an excitation sequence which, applied to the short-term synthesis filter, supplies a synthetic signal constituting an estimate of the speech signal S according to a perceptual weighting criterion.

The short-term synthesis filter has a transfer function of the form 1/A(z), with:

$$A(z) = 1 - \sum_{i=1}^{q} a_i \cdot z^{-i}$$

The coefficients $a_i$ are determined by a module 26 for short-term linear prediction analysis of the speech signal S. The $a_i$'s are the coefficients of linear prediction of the speech signal S. The order q of the linear prediction is typically of the order of 10. The methods which can be applied by the module 26 for the short-term linear prediction are well known in the field of speech coding. The module 26, for example, implements the Durbin-Levinson algorithm (see J. Makhoul: "Linear Prediction: A tutorial review", Proc. IEEE, Vol. 63, no. Apr. 4, 1975, p. 561–580). The coefficients $a_i$ obtained are supplied to a module 28 which converts them into line spectrum parameters (LSP). The representation of the prediction coefficients $a_i$ by LSP parameters is frequently used in analysis-by-synthesis speech coders. The LSP parameters are the q numbers $\cos(2\pi f_i)$ ranged in decreasing order, the q normalised line spectrum frequencies (LSF) $f_i$ ($1 \leqq i \leqq q$) being such that the complex numbers $\exp(2\pi j f_i)$, with i=1, 3, . . . , q−1, q+1 and $f_{q+1}=0.5$, are the roots of the polynomial Q(z) defined by $Q(z)=A(z)+z^{-(q+1)}\cdot A(z^{-1})$ and that the complex numbers $\exp(2\pi j f_i)$, with i=0, 2, 4, . . . q and $f_0=0$, are the roots of the polynomial Q*(z) defined by $Q^*(z)=A(z)-z^{-(q+1)}\cdot A(z^{-1})$.

The LSP parameters may be obtained by the conversion module 28 by the conventional method of Chebyshev polynomials (see P. Kabal and R. P Ramachandran: "The computation of line spectral frequencies using Chebyshev polynomials", IEEE Trans. ASSP, Vol. 34, no. 6, 1986, pages 1419–1426). It is these values of quantification of the LSP parameters, obtained by a quantification module 30, which are forwarded to the decoder for it to recover the coefficients $a_i$ of the short-term synthesis filter. The coefficients $a_i$ may be recovered simply, given that:

$$Q(z) = (1 + z^{-1}) \prod_{i=1,3,\ldots,q-1} (1 - 2\cos(2\pi f_i)z^{-1} + z^{-2})$$

$$Q^*(z) = (1 - z^{-1}) \prod_{i=2,4,\ldots,q} (1 - 2\cos(2\pi f_i)z^{-1} + z^{-2})$$

$$\text{and } A(z) = [Q(z) + Q^*(z)]/2$$

In order to avoid abrupt variations in the transfer function of the short-term synthesis filter, the LSP parameters are subject to interpolation before the prediction coefficients $a_i$ are deduced from them. This interpolation is performed on the first sub-frames of each frame of the signal. For example, if $LSP_t$ and $LSP_{t-1}$ respectively designate an LSP parameter calculated for frame t and for the preceding frame t−1, then $LSP_t(0)=0.5LSP_{t-1}+0.5LSP_t$, $LSP_t(1)=0.25LSP_{t-1}+0.75LSP_t$ and $LSP_t(2)=\ldots=LSP_t(nst-1)=LSP_t$ for the sub-frames 0, 1, 2, . . . , nst−1 of frame t. The coefficients $a_i$ of the 1/A(z) filter are then determined, sub-frame by sub-frame, on the basis of the interpolated LSP parameters.

The unquantified LSP parameters are supplied by the module 28 to a module 32 for calculating the coefficients of a perceptual weighting filter 34. The perceptual weighting filter 34 preferably has a transfer function of the form $W(z)=A(z/\gamma_1)/A(z/\gamma_2)$ where $\gamma_1$ and $\gamma_2$ are coefficients such that $\gamma_1>\gamma_2>0$ (for example, $\gamma_1=0.9$ and $\gamma_2=0.6$). The coefficients of the perceptual weighting filter are calculated by the module 32 for each sub-frame after interpolation of the LSP parameters received from the module 28.

The perceptual weighting filter 34 receives the speech signal S and delivers a perceptually weighted signal SW which is analysed by modules 36, 38, 40 in order to determine the excitation sequence. The excitation sequence of the short-term filter consists of an excitation which can be predicted by a long-term synthesis filter modelling the pitch of the speech, and of an unpredictable stochastic excitation, or innovation sequence.

The module 36 performs a long-term prediction (LTP) in open loop, that is to say that it does not contribute directly to minimising the weighted error. In the case represented, the weighting filter 34 intervenes upstream of the open-loop analysis module, but it could be otherwise: the module 36 could act directly on the speech signal S, or even on the signal S with its short-term correlations removed by a filter with transfer function A(z). On the other hand, the modules 38 and 40 operate in closed loop, that is to say that they contribute directly to minimising the perceptually weighted error.

The long-term synthesis filter has a transfer function of the form 1/B(z), with $B(z)=1-g_p\cdot z^{-TP}$, in which $g_p$ designates a long-term prediction gain and TP designates a long-term prediction delay. The long-term prediction delay may typically take N=256 values lying between rmin and rmax samples. Fractional resolution is provided for the smallest values of delay so as to avoid differences which are too perceptible in terms of voicing frequency. A resolution of ⅙ is used, for example, between rmin=21 and 33+⅚, a resolution of ⅓ between 34 and 47+⅔, a resolution of ½ between 48 and 88+½, and integer resolution between 89 and rmax=142. Each possible delay is thus quantified by an integer index lying between 0 and N−1=255.

The long-term prediction delay is determined in two stages. In the first stage, the open-loop LTP analysis module 36 detects the voiced frames of the speech signal and, for each voiced frame, determines a degree of voicing MV and a search interval for the long-term prediction delay. The degree of voicing MV of a voiced frame may take three values: 1 for the slightly voiced frames, 2 for the moderately voiced frames and 3 for the very voiced frames. In the notation used below, a degree of voicing of MV=0 is taken for the unvoiced frames. The search interval is defined by a central value represented by its quantification index ZP and by a width in the field of quantification indices, dependent on the degree of voicing MV. For the slightly or moderately voiced frames (MV=1 or 2) the width of the search interval is of N1 indices, that is to say that the index of the long-term prediction delay will be sought between ZP−16 and ZP+15 if N1=32. For the very voiced frames (MV=3), the width of the search interval is of N3 indices, that is to say that the index of the long-term prediction delay will be sought between ZP−8 and ZP+7 if N3=16.

Once the degree of voicing MV of a frame has been determined by the module 36, the module 30 carries out the quantification of the LSP parameters which were determined beforehand for this frame. This quantification is vectorial, for example, that is to say that it consists in selecting, from one or more predetermined quantification tables, a set of quantified parameters $LSP_Q$ which exhibits a minimum distance with the set of LSP parameters supplied by the module 28. In a known way, the quantification tables differ depending on the degree of voicing MV supplied to the quantification module 30 by the open-loop analyser 36. A set of quantification tables for a degree of voicing MV is determined, during trials beforehand, so as to be statistically representative of frames having this degree MV. These sets are stored both in the coders and in the decoders implementing the invention. The module 30 delivers the set of quantified parameters $LSP_Q$ as well as its index Q in the applicable quantification tables.

The speech coder 16 further comprises a module 42 for calculating the impulse response of the composite filter of the short-term synthesis filter and of the perceptual weighting filter. This composite filter has the transfer function W(z)/A(z). For calculating its impulse response h=(h(0), h(1), . . . , h(1st−1)) over the duration of one sub-frame, the module 42 takes, for the perceptual weighting filter W(z), that corresponding to the interpolated but unquantified LSP parameters, that is to say the one whose coefficients have beet calculated by the module 32, and, for the synthesis filter 1/A(z), that corresponding to the quantified and interpolated LSP parameters, that is to say the one which will actually be reconstituted by the decoder.

In the second stage of the determination of the long-term prediction delay TP, the closed-loop LTP analysis module 38 determines the delay TP for each sub-frame of the voiced frames (MV=1, 2 or 3). This delay TP is characterised by a differential value DP in the domain of the quantification indices, coded over 5 bits if MV=1 or 2 (N1=32), and over 4 bits if MV=3 (N3=16). The index of the delay TP is equal to ZP+DP. In a known way, the closed-loop LTP analysis consists in determining in the search interval for the long-term prediction delays T, the delay TP which, for each sub-frame of a voiced frame, maximises the normalised correlation:

$$\frac{\left[\sum_{i=0}^{lst-1} x(i)\cdot y_T(i)\right]^2}{\sum_{i=0}^{lst-1} [y_T(i)]^2}$$

where x(i) designates the weighted speech signal SW of the sub-frame from which has been subtracted the memory of the weighted synthesis filter (that is to say the response to a zero signal, due to its initial states, of the filter whose impulse response h was calculated by the module 42), and $Y_T(i)$ designates the convolution product:

$$y_T^{(i)} = u(i-T) * h(i) = \sum_{j=0}^{i} u(j-T)\cdot h(i-j) \tag{1}$$

u(j−T) designating the predictable component of the excitation sequence delayed by T samples, estimated by the well-known technique of the adaptive codebook. For delays T shorter than the length of a sub-frame, the missing values of u(j−T) can be extrapolated from the previous values. The fractional delays are taken into account by oversampling the signal u(j−T) in the adaptive codebook. Oversampling by a factor m is obtained by means of interpolating multi-phase filters.

The long-term prediction gain $g_p$ could be determined by the module 38 for each sub-frame, by applying the known formula:

$$g_P = \frac{\sum_{i=0}^{lst-1} x(i)\cdot y_{TP}(i)}{\sum_{i=0}^{lst-1} [y_{TP}(i)]^2}$$

However, in a preferred version of the invention, the gain $g_p$ is calculated by the stochastic analysis module 40.

The stochastic excitation determined for each sub-frame by the module 40 is of the multi-pulse type. An innovation sequence of 1st samples comprises np pulses with positions p(n) and amplitude g(n). Put another way, the pulses have an amplitude of 1 and are associated with respective gains g(n). Given that the LTP delay is not determined for the sub-frames of the unvoiced frames, a higher number of pulses can be taken for the stochastic excitation relating to these sub-frames, for example np=5 if MV=1, 2 or 3 and np=6 if MV=0. The positions and the gains calculated by the stochastic analysis module 40 are quantified by a module 44.

A bit ordering module 46 receives the various parameters which will be useful to the decoder, and compiles the binary sequence forwarded to the channel coder 22. These parameters are:

- the index Q of the LSP parameters quantified for each frame;
- the degree of voicing MV of each frame;
- the index ZP of the centre of the LTP delays search interval for each voiced frame;
- the differential index DP of the LTP delay for each sub-frame of a voiced frame, and the associated gain $g_p$;
- the positions p(n) and the gains g(n) of the pulses of the stochastic excitation for each sub-frame.

Some of these parameters may be of particular importance in the quality of reproduction of the speech, or be particularly sensitive to transmission errors. A module 48 is therefore provided, in the coder, which receives the various parameters and adds redundancy bits to some of them, making it possible to detect and/or correct any transmission errors. For example, as the degree of voicing MV, coded over two bits, is a critical parameter, it is desirable for it to arrive at the decoder with as few errors as possible. For that reason, redundancy bits are added to this parameter by the module 48. It is possible, for example, to add a parity bit to the two MV coding bits and to repeat the three bits thus obtained once. This example of redundancy makes it possible to detect all single or double errors and to correct all the single errors and 75% of the double errors.

The allocation of the binary data rate per 20 ms frame is, for example, that indicated in table I.

TABLE I

| quantified parameters | MV = 0 | MV = 1 or 2 | MV = 3 |
|---|---|---|---|
| LSP | 34 | 34 | 34 |
| MV + redundancy | 6 | 6 | 6 |
| ZP | — | 8 | 8 |
| DP | — | 20 | 16 |
| $g_{TP}$ | — | 20 | 24 |
| pulse positions | 80 | 72 | 72 |
| pulse gains | 140 | 100 | 100 |
| Total | 260 | 260 | 260 |

In the example considered here, the channel coder 22 is the one used in the pan-European system for radio communication with mobiles (GSM). This channel coder, described in detail in GSM Recommendation 05.03, was developed for a 13 kbit/s speech coder of RPE-LTP type which also produces 260 bits per 20 ms frame. The sensitivity of each of the 260 bits has been determined on the basis of listening tests. The bits output by the source coder have been grouped together into three categories. The first of these categories IA groups together 50 bits which are coded by convolution on the basis of a generator polynomial giving a redundancy of one half with a constraint length equal to 5. Three parity bits are calculated and added to the 50 bits of category IA before the convolutional coding. The second category (IB) numbers 132 bits which are protected to a level of one half by the same polynomial as the previous category. The third category (II) contains 78 unprotected bits. After application of the convolutional code, the bits (456 per frame) are subjected to interleaving. The ordering module 46 of the new source coder implementing the invention distributes the bits into the three categories on the basis of the subjective importance of these bits.

Figure 2:
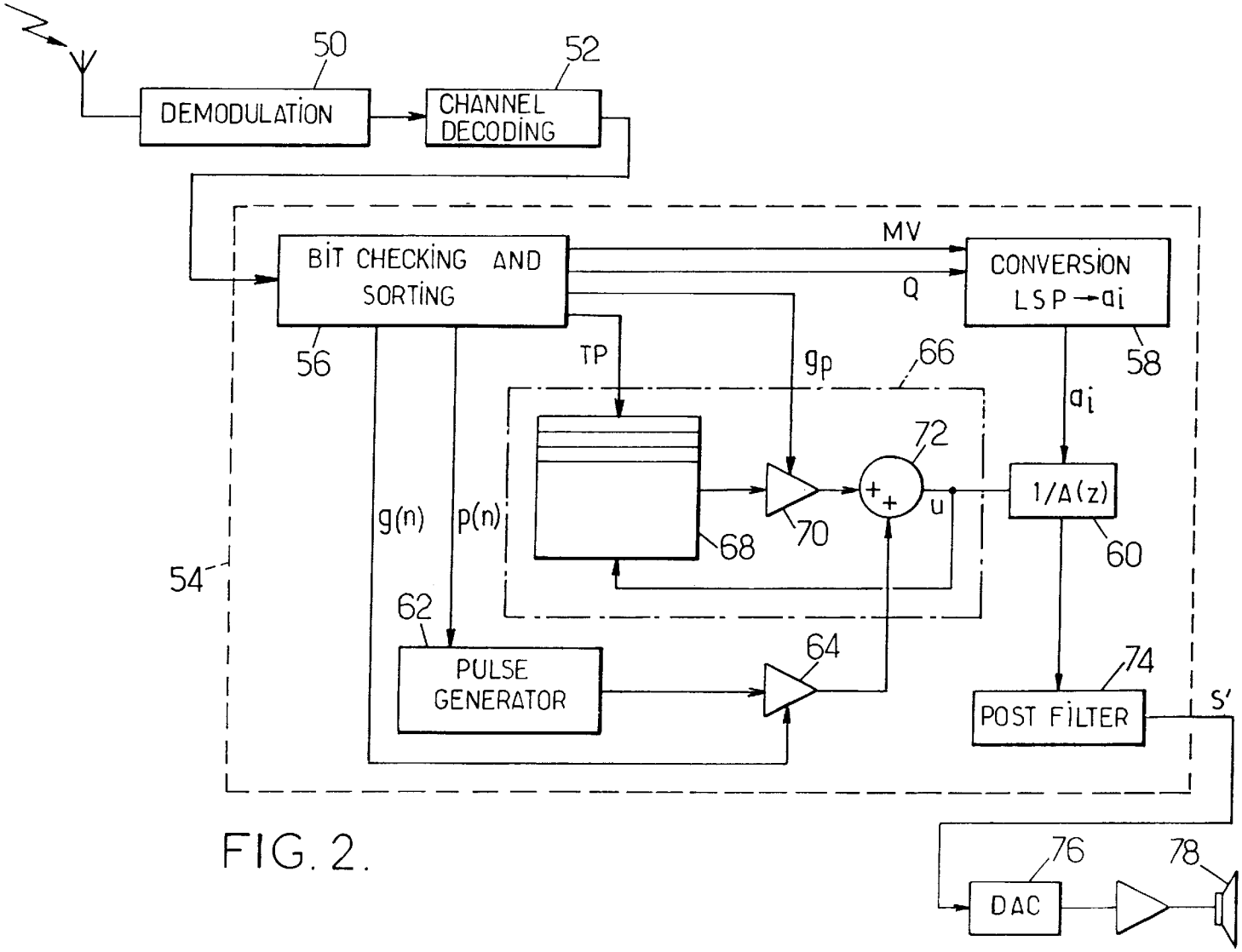
FIG. 2 is a block diagram of a radio communications station able to receive a signal produced by the station of FIG. 1.
Figure 3:
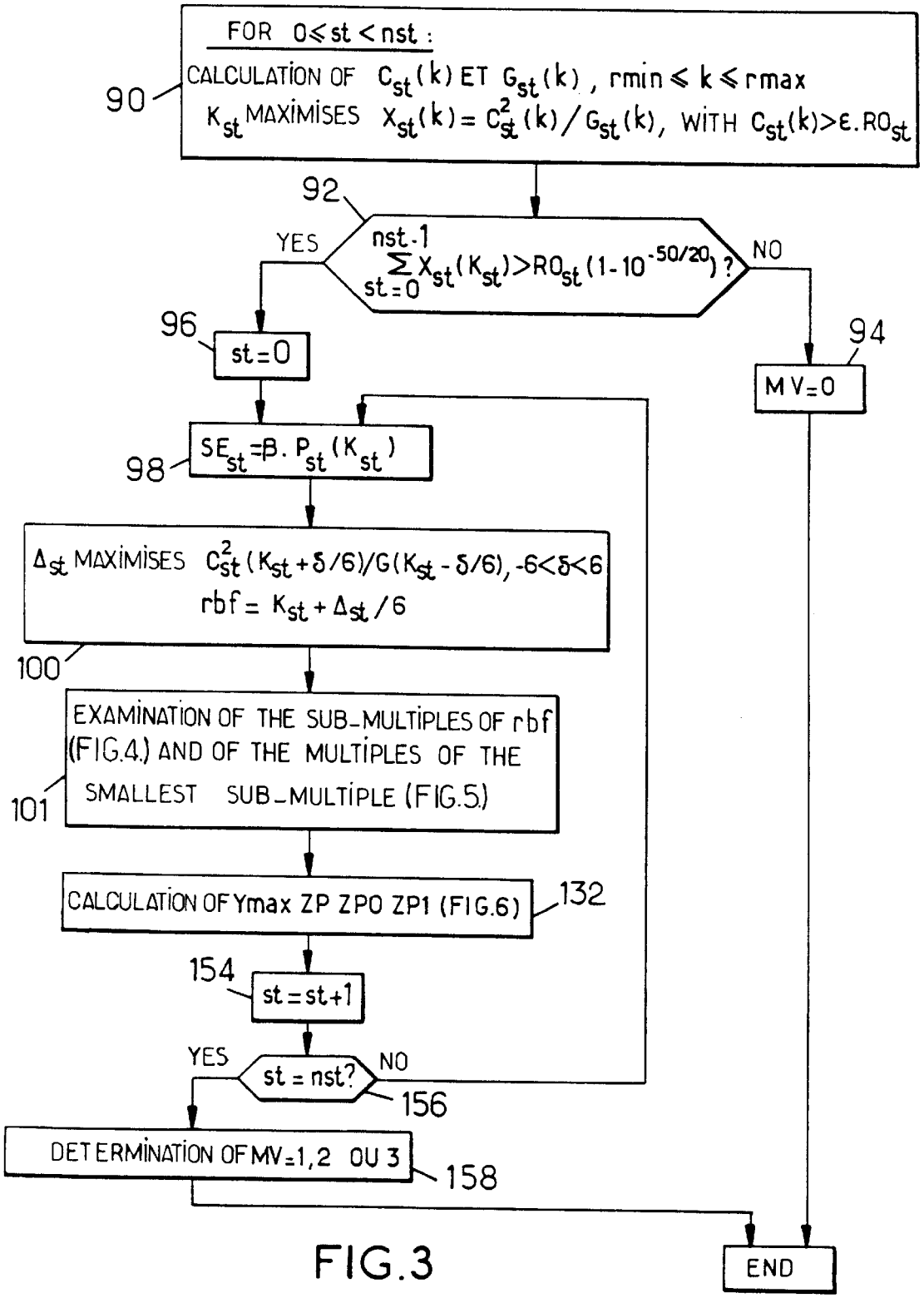
FIGS. 3 to 6 are flow charts illustrating a process of open-loop LTP analysis applied in the speech coder of FIG. 1.
Figure 4:
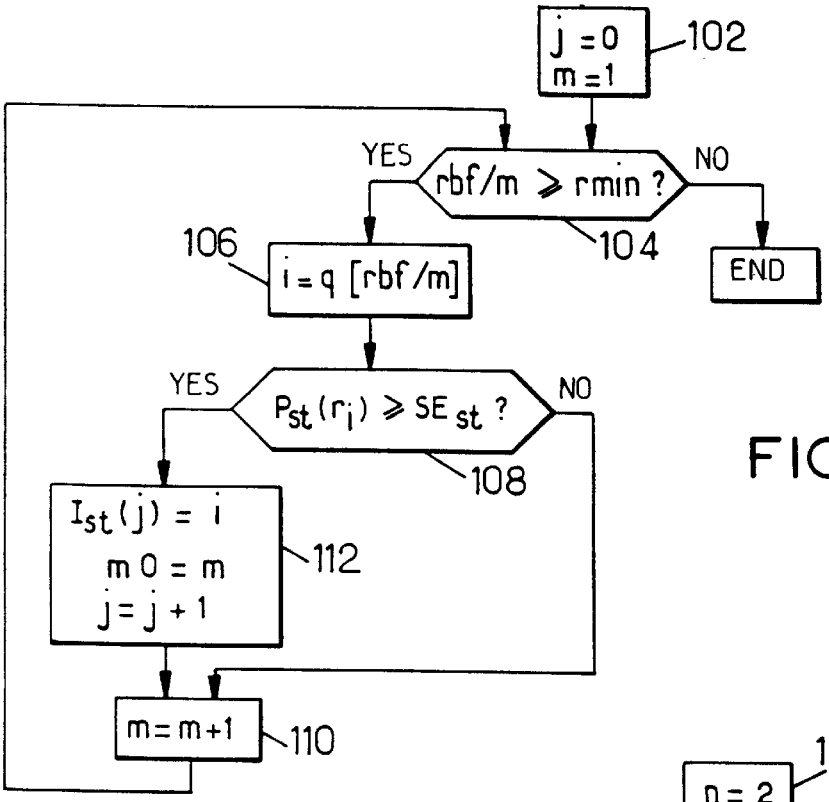

A mobile radio communications station able to receive the speech signal processed by the source coder 16 is represented diagrammatically in FIG. 2. The radio signal received is first of all processed by a demodulator 50 then by a channel decoder 52 which perform the dual operations of those of the modulator 24 and of the channel coder 22. The channel decoder 52 supplies the speech decoder 54 with a binary sequence which, in the absence of transmission errors or when any errors have been corrected by the channel decoder 52, corresponds to the binary sequence which the ordering module 46 delivered at the coder 16. The decoder 54 comprises a module 56 which receives this binary sequence and which identifies the parameters relating to the various frames and sub-frames. The module 56 also performs a few checks on the parameters received. In particular, the module 56 examines the redundancy bits inserted by the module 48 of the coder, in order to detect and/or correct the errors affecting the parameters associated with these redundancy bits.

For each speech frame to be synthesised, a module 58 of the decoder receives the degree of voicing MV and the Q index of quantification of the LSP parameters. The module 58 recovers the quantified LSP parameters from the tables corresponding to the value of MV and, after interpolation, converts them into coefficients $a_i$ for the short-term synthesis filter 60. For each speech sub-frame to be synthesised, a pulse generator 62 receives the positions p(n) of the np pulses of the stochastic excitation. The generator 62 delivers pulses of unit amplitude which are each multiplied at 64 by the associated gain g(n). The output of the amplifier 64 is applied to the long-term synthesis filter 66. This filter 66 has an adaptive codebook structure. The output samples u of the filter 66 are stored in memory in the adaptive codebook 68 so as to be available for the subsequent sub-frames. The delay TP relating to a sub-frame, calculated from the quantification indices ZP and DP, is supplied to the adaptive codebook 68 to produce the signal u delayed as appropriate. The amplifier 70 multiplies the signal thus delayed by the long-term prediction gain $g_p$. The long-term filter 66 finally comprises an adder 72 which adds the outputs of the amplifiers 64 and 70 to supply the excitation sequence u. When the LTP analysis has not been performed at the coder, for example if MV=0, a zero prediction gain $g_p$ is imposed on the amplifier 70 for the corresponding sub-frames. The excitation sequence is applied to the short-term synthesis filter 60, and the resulting signal can further, in a known way, be submitted to a post-filter 74, the coefficients of which depend on the received synthesis parameters, in order to form the synthetic speech signal S'. The output signal S' of the decoder 54 is then converted to analogue by the converter 76 before being amplified in order to drive a loudspeaker 78.

The open-loop LTP analysis process implemented by the module 36 of the coder, according to a first aspect of the invention, will now be described with reference to FIGS. 3 to 6.

In a first stage 90, the module 36, for each sub-frame st=0, 1, . . . , nst−1 of the current frame, calculates and stores the autocorrelations $C_{st}(k)$ and the delayed energies $G_{st}(k)$ of the weighted speech signal SW for the integer delays k lying between rmin and rmax:

$$C_{st}(k) = \sum_{i=st\cdot lst}^{(st+1)\cdot lst-1} SW(i)\cdot SW(i-k)$$

$$G_{st}(k) = \sum_{i=st\cdot lst}^{(st+1)\cdot lst-1} [SW(i-k)]^2$$

The engergies per sub-frame $R0_{st}$ are also calculated:

$$R0_{st} = \sum_{i=st\cdot lst}^{(st+1)\cdot lst-1} [SW(i)]^2$$

At stage 90, the module 36 furthermore, for each sub-frame st, determines the integer delay $K_{st}$ which maximises the open-loop estimate $P_{st}(k)$ of the long-term prediction gain over the sub-frame st, excluding those delays k for which the autocorrelation $C_{st}(k)$ is negative or smaller than a small fraction $\epsilon$ of the energy $R0_{st}$ of the sub-frame. The estimate $P_{st}(k)$, expressed in decibels, is expressed:

$$P_{st}(k)=20\cdot \log_{10}[R0_{st}/(R0_{st}-C_{st}^2(k)/G_{st}(k))]$$

Figure 6:
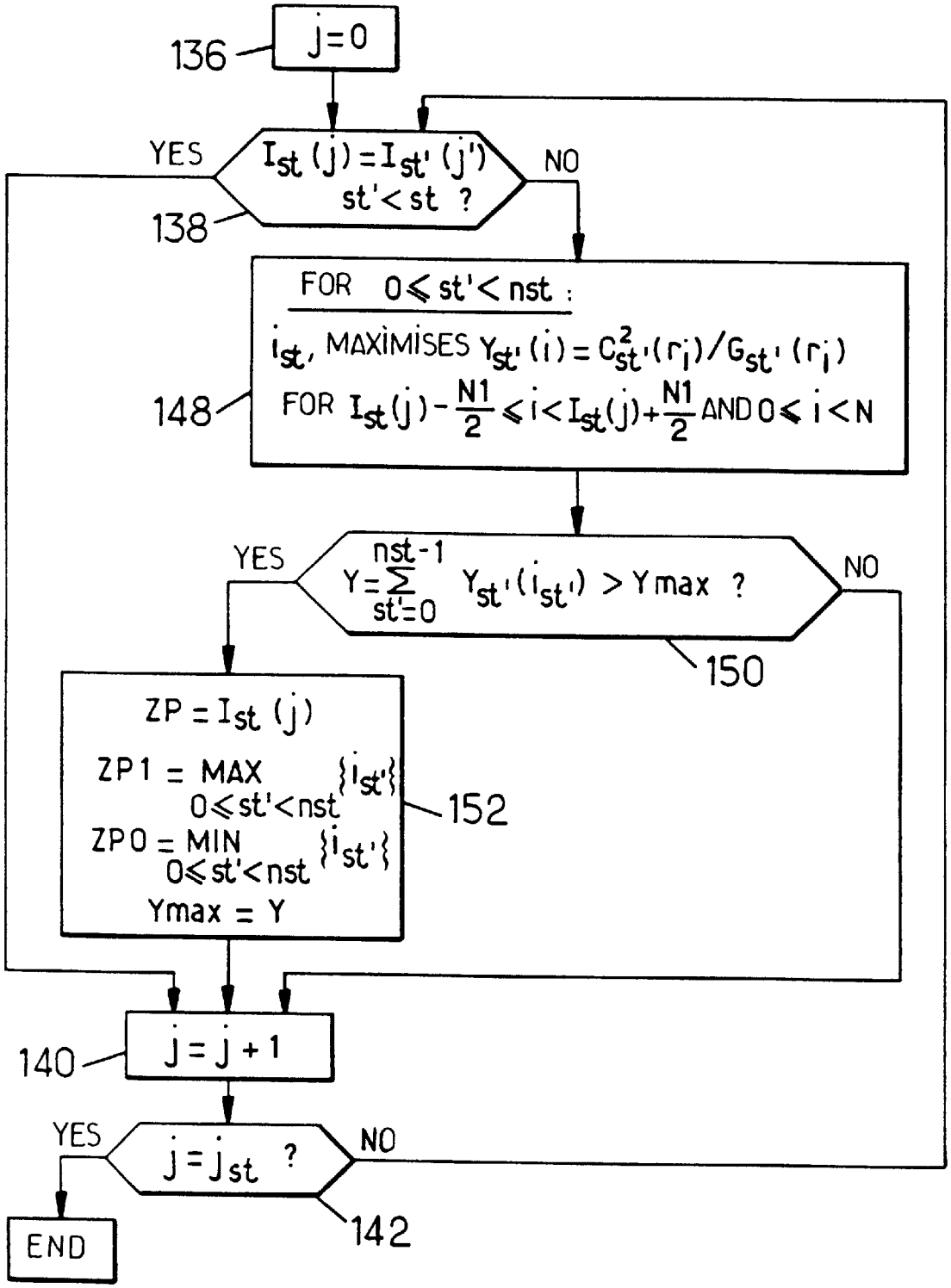

Maximising $P_{st}(k)$ thus amounts to maximising the expression $X_{st}(k)=C_{st}^2(k)/G_{st}(k)$ as indicated in FIG. 6. The integer delay $K_{st}$ is the basic delay in integer resolution for the sub-frame st. Stage 90 is followed by a comparison 92 between a first open-loop estimate of the global prediction gain over the current frame and a predetermined threshold S0 typically lying between 1 and 2 decibels (for example, S0=1.5 dB) . The first estimate of the global prediction gain is equal to:

$$20\cdot\log_{10}\left[R0\Big/\left[R0-\sum_{st=0}^{nst-1}X_{st}(K_{st})\right]\right]$$

where R0 is the total energy of the frame ($R0=R0_0+R0_1+\ldots+R0_{nst-1}$), and $X_{st}(K_{st})=C_{st}^2(K_{st})/G_{st}(K_{st})$ designates the maximum determined at stage 90 relative to the sub-frame st. As FIG. 6 indicates, the comparison 92 can be performed without having to calculate the logarithm.

If the comparison 92 shows a first estimate of the prediction gain below the threshold S0, it is considered that the speech signal contains too few long-term correlations to be voiced, and the degree of voicing MV of the current frame is taken as equal to 0 at stage 94, which, in this case, terminates the operations performed by the module 36 on this frame. If, in contrast, the threshold S0 is crossed at stage 92, the current frame is detected as voiced and the degree MV will be equal to 1, 2 or 3. The module 36 then, for each sub-frame st, calculates a list $I_{st}$ containing candidate delays to constitute the centre ZP of the search interval for the long-term prediction delays.

The operations performed by the module 36 for each sub-frame st (st initialised to 0 at stage 96) of a voiced frame commence with the determination 98 of a selection threshold $SE_{st}$ in decibels equal to a defined fraction β of the estimate $P_{st}(K_{st})$ of the prediction gain in decibels over the sub-frame, maximised at stage 90 (β=0.75 typically). For each sub-frame st of a voiced frame, the module 36 determines the basic delay rbf in integer resolution for the remainder of the processing. This basic delay could be taken as equal to the integer $K_{st}$ obtained at stage 90. The fact of searching for the basic delay in fractional resolution around $K_{st}$ makes it possible, however, to gain in terms of precision. Stage 100 thus consists in searching around the integer delay $K_{st}$ obtained at stage 90, for the fractional delay which maximises the expression $C_{st}^2/G_{st}$. This search can be performed at the maximum resolution of the fractional delays (⅙ in the example described here) even if the integer delay $K_{st}$ is not in the domain in which this maximum resolution applies. For example, the number Δst which maximises $C_{st}^2(K_{st}+\delta/6)/G_{st}(K_{st}+\delta/6)$ is determined for $-6<\delta<+6$, then the basic delay rbf in maximum resolution is taken as equal to $K_{st}+\Delta_{st}/6$. For the fractional values T of the delay, the autocorrelations $C_{st}(T)$ and the delayed energies $G_{st}(T)$ are obtained by interpolation from values stored in memory at stage 90 for the integer delays. Clearly, the basic delay relating to a sub-frame could also be determined in fractional resolution as from stage 90 and taken into account in the first estimate of the global prediction gain over the frame.

Figure 5:
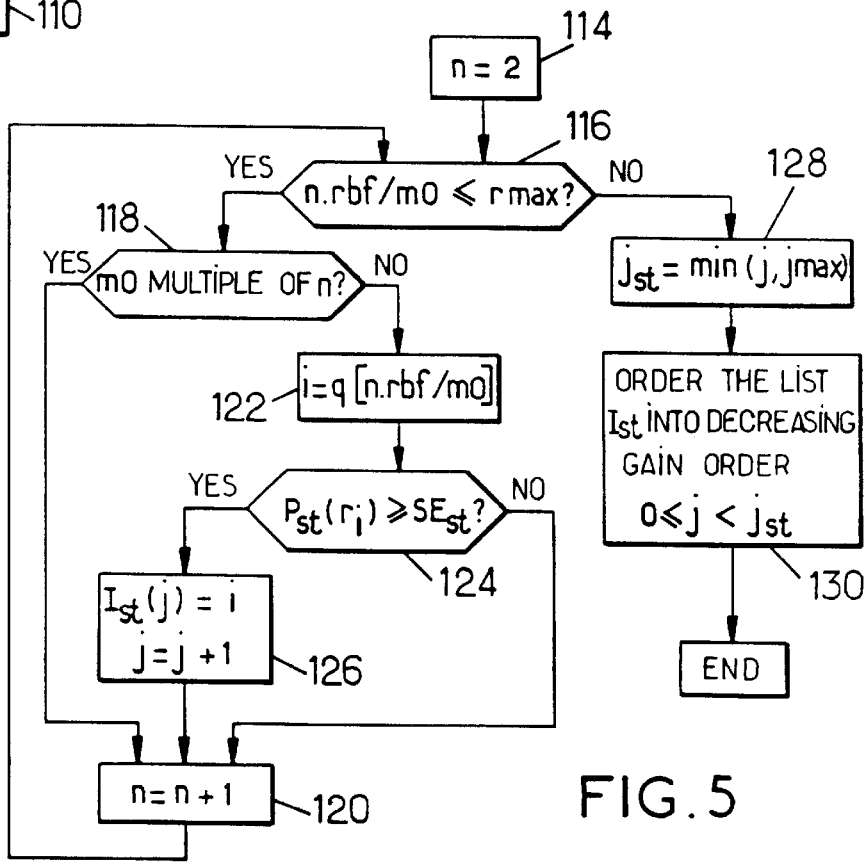

Once the basic delay rbf has been determined for a sub-frame, an examination 101 is carried out of the sub-multiples of this delay so as to adopt those for which the prediction gain is relatively high (FIG. 4), then of the multiples of the smallest sub-multiple adopted (FIG. 5). At stage 102, the address j in the list $I_{st}$ and the index m of the sub-multiple are initialised at 0 and 1 respectively. A comparison 104 is performed between the sub-multiple rbf/m and the minimum delay rmin. The sub-multiple rbf/m has to be examined to see whether it is higher than rmin. The value of the index of the quantified delay $r_i$ which is closest to rbf/m (stage 106) is then taken for the integer i, then, at 108, the estimated value of the prediction gain $P_{st}(r_i)$ associated with the quantified delay $r_i$ for the sub-frame in question is compared with the selection threshold $SE_{st}$ calculated at stage 98:

$$P_{st}(r_i)=20\cdot\log_{10}\left[R0_{st}/\left(R0_{st}-C_{st}^2(r_i)/G_{st}(r_i)\right)\right]$$

with, in the case of the fractional delays, an interpolation of the values $C_{st}$ and $G_{st}$ calculated at stage 90 for the integer delays. If $P_{st}(r_i)<SE_{st}$, the delay $r_i$ is not taken into consideration, and stage 110 for incrementing the index m is entered directly before again performing the comparison 104 for the following sub-multiple. If the test 108 shows that $P_{st}(r_i)\geqq SE_{st}$, the delay $r_i$ is adopted and stage 112 is executed before the index m is incremented at stage 110. At stage 112, the index i is stored in memory at address j in the list $I_{st}$, the value m is given to the integer m0 intended to be equal to the index of the smallest sub-multiple adopted, then the address j is incremented by one unit.

The examination of the sub-multiples of the basic delay is terminated when the comparison 104 shows rbf/m<rmin. Then those delays are examined which are multiples of the smallest rbf/m0 of the sub-multiples previously adopted following the process illustrated in FIG. 5. This examination commences with initialisation 114 of the index n of the multiple: n=2. A comparison 116 is performed between the multiple n·rbf/m0 and the maximum delay rmax. If n·rbf/m0>rmax, the test 118 is performed in order to determine whether the index m0 of the smallest sub-multiple is an integer multiple of n. If so, the delay n·rbf/m0 has already been examined during the examination of the sub-multiples of rbf, and stage 120 is entered directly, for incrementing the index n before again performing the comparison 116 for the following multiple. If the test 118 shows that m0 is not an integer multiple of n, the multiple n·rbf/m0 has to be examined. The value of the index of the quantified delay $r_i$ which is closest to n·rbf/m0 (stage 122) is then taken for the integer i, then, at 124, the estimated value of the prediction gain $P_{st}(r_i)$ is compared with the selection threshold $SE_{st}$. If $P_{st}(r_i)<SE_{st}$, the delay $r_i$ is not taken into consideration, and stage 120 for incrementing the index n is entered directly. If the test 124 shows that $P_{st}(r_i)\geqq SE_{st}$, the delay $r_i$ is adopted, and stage 126 is executed before incrementing the index n at stage 120. At stage 126, the index i is stored in memory at address j in the list $I_{st}$, then the address j is incremented by one unit.

The examination of the multiples of the smallest sub-multiple is terminated when the comparison 116 shows that n·rbf/m0>rmax. At that point, the list $I_{st}$ contains j indices of candidate delays. If it is desired, for the following stages, to limit the maximum length of the list $I_{st}$ to jmax, the length $j_{st}$ of this list can be taken as equal to min(j, jmax) (stage 128) then, at stage 130, the list $I_{st}$ can be sorted in the order of decreasing gains $C_{st}^2(r_{Ist(j)})/G_{st}^2(r_{Ist(j)})$ for $0\leqq j<j_{st}$ so as to preserve only the $j_{st}$ delays yielding the highest values of gain. The value of jmax is chosen on the basis of the compromise envisaged between the effectiveness of the search for the LTP delays and the complexity of this search. Typical values of jmax range from 3 to 5.

Once the sub-multiples and the multiples have been examined and the list $I_{st}$ has thus been obtained (FIG. 3), the analysis module 36 calculates a quantity Ymax determining a second open-loop estimate of the long-term prediction gain over the whole of the frame, as well as indices ZP, ZP0 and ZP1 in a phase 132, the progress of which is detailed in FIG. 6. This phase 132 consists in testing search intervals of length N1 to determine the one which maximises a second estimate of the global prediction gain over the frame. The intervals tested are those whose centres are the candidate delays contained in the list $I_{st}$ calculated during phase 101. Phase 132 commences with a stage 136 in which the address j in the list $I_{st}$ is initialised to 0. At stage 138, the index $I_{st}(j)$ is checked to see whether it has already been encountered by testing a preceding interval centred on $I_{st'}(j')$ with st'<st and $0 \leqq j' < j_{st'}$, so as to avoid testing the same interval twice. If the test 138 reveals that $I_{st}(j)$ already featured in a list $I_{st'}$ with st'<st, the address j is incremented directly at stage 140, then it is compared with the length $j_{st}$ of the list $I_{st}$. If the comparison 142 shows that $j<j_{st}$, stage 138 is re-entered for the new value of the address j. When the comparison 142 shows that $j=j_{st}$, all the intervals relating to the list $I_{st}$ have been tested, and phase 132 is terminated. When test 138 is negative, the interval centred on $I_{st}(j)$ is tested, starting with stage 148 at which, for each sub-frame st', the index $I_{st'}$, is determined of the optimal delay which, over this interval, maximises the open-loop estimate $P_{st}(r_i)$ of the long-term prediction gain, that is to say which maximises the quantity $Y_{st'}(i)=C_{st'}^{2}(r_i)/G_{st'}(r_i)$ in which $r_i$ designates the quantified delay of index i for $I_{st}(j)-N1/2 \leqq i < I_{st}(j)+N1/2$ and $0 \leqq i < N$. During the maximisation 148 relating to a sub-frame st', those indices i for which the autocorrelation $C_{st'}(r_i)$ is negative are set aside, a priori, in order to avoid degrading the coding. If it is found that all the values of i lying in the interval tested [I(j)−N1/2, I(j)+N1/2[ give rise to negative autocorrelations $C_{st}(r_i)$, the index $i_{st'}$, for which this autocorrelation is smallest in absolute value is selected. Next, at 150, the quantity Y determining the second estimate of the global prediction gain for the interval centred on $I_{st}(j)$ is calculated according to:

$$Y = \sum_{st'=0}^{nst-1} Y_{st'}(i_{st'})$$

then compared with Ymax, where Ymax represents the value to be maximised. This value Ymax is, for example, initialised to 0 at the same time as the index st at stage 96. If $Y \leqq Ymax$, stage 140 for incrementing the index j is entered directly. If the comparison 150 shows that Y>Ymax, stage 152 is executed before incrementing the address j at stage 140. At this stage 152, the index ZP is taken as equal to $I_{st}(j)$ and the indices ZP0 and ZP1 are taken as equal respectively to the smallest and to the largest of the indices $i_{st}$, determined at stage 148.

At the end of phase 132 relating to a sub-frame st, the index st is incremented by one unit (stage 154) then, at stage 156, compared with the number nst of sub-frames per frame. If st<nst, stage 98 is re-entered to perform the operations relating to the following sub-frame. When the comparison 156 shows that st=nst, the index ZP designates the centre of the search interval which will be supplied to the closed-loop LTP analysis module 38, and ZP0 and ZP1 are indices, the difference between which is representative of the dispersion on the optimal delays per sub-frame in the interval centred on ZP.

At stage 158, the module 36 determines the degree of voicing MV, on the basis of the second open-loop estimate of the gain expressed in decibels: $Gp=20 \cdot \log_{10}(R0/R0-Ymax)$. Two other thresholds S1 and S2 are made use of. If Gp<S1, the degree of voicing MV is taken as equal to 1 for the current frame. The threshold S1 typically lies between 3 and 5 dB; for example, S1=4 dB. If S1<Gp<S2, the degree of voicing MV is taken as equal to 2 for the current frame. The threshold S2 typically lies between 5 and 8 dB; for example, S2=7 dB. If Gp>S2, the dispersion in the optimal delays for the various sub-frames of the current frame is examined. If ZP1−ZP<N3/2 and $ZP-ZP0 \leqq N3/2$, an interval of length N3 centred on ZP suffices to take account of all the optimum delays and the degree of voicing is taken as equal to 3 (if Gp>S2) . Otherwise, if $ZP1-ZP \geqq N3/2$ or ZP−ZP0>N3/2, the degree of voicing is taken as equal to 2 (if Gp>S2).

The index ZP of the centre of the prediction delay search interval for a voiced frame may lie between 0 and N−1=255, and the differential index DP determined for the module 38 may range from −16 to +15 if MV=1 or 2, and from −8 to +7 if MV=3 (case of N1=32, N3=16). The index ZP+DP of the delay TP finally determined may therefore, in certain cases, be less than 0 or greater than 255. This allows the closed-loop LTP analysis to range equally over a few delays TP smaller than rmin or larger than rmax. Thus the subjective quality of the reproduction of the so-called pathological voices and of non-vocal signals (DTMF voice frequencies or signalling frequencies used by the switched telephone network) is enhanced. Another possibility is to take, for the search interval, the first or last 32 quantification indices of the delays if ZP<16 or ZP>240 with MV=1 or 2, and the first or last 16 indices if ZP<8 or ZP>248 with MV=3.

The fact of reducing the delay search interval for very voiced frames (typically 16 values for MV=3 instead of 32 for MV=1 or 2) makes it possible to reduce the complexity of the closed-loop LTP analysis performed by the module 38 by reducing the number of convolutions $Y_T(i)$ to be calculated according to formula (1). Another advantage is that one coding bit of the differential index DP is saved. As the output data rate is constant, this bit can be reallocated to coding of other parameters. In particular, this supplementary bit can be allocated to quantifying the long-term prediction gain $g_p$ calculated by the module 40. In fact, a higher precision on the gain $g_p$ by virtue of an additional quantifying bit is appreciable since this parameter is perceptually important for very voiced sub-frames (MV=3). Another possibility is to provide a parity bit for the delay TP and/or the gain $g_p$, making it possible to detect any errors affecting these parameters.

A few modifications can be made to the open-loop LTP analysis process described above by reference to FIGS. 3 to 6.

According to a first variant of this process, the first optimisations performed at stage 90 relating to the various sub-frames are replaced by a single optimisation covering the whole of the frame. In addition to the parameters $C_{st}(k)$ and $G_{st}(k)$ calculated for each sub-frame st, the autocorrelations C(k) and the delayed energies G(k) are also calculated for the whole of the frame:

$$C(k) = \sum_{st=0}^{nst-1} C_{st}(k)$$

$$G(k) = \sum_{st=0}^{nst-1} G_{st}(k)$$

Then the basic delay is determined in integer resolution K which maximises $X(k)=C^2(k)/G(k)$ for $rmin \leqq k \leqq rmax$. The first estimate of the gain compared at S0at stage 92 is then $P(K)=20 \cdot \log_{10}[R0/[R0-X(K)]]$. Next a single basic delay is determined around K in fractional resolution rbf, and the examination 101 of the sub-multiples and of the multiples is performed once and produces a single list I instead of nst lists $I_{st}$. Phase 132 is then performed a single time for this list I, distinguishing the sub-frames only at stages 148, 150 and 152. This variant embodiment has the advantage of reducing the complexity of the open-loop analysis.

According to a second variant of the open-loop LTP analysis process, the domain [rmin, rmax] of possible delays is subdivided into nz sub-intervals having for example, the same length (nz=3 typically), and the first optimisations performed at stage 90 relating to the various sub-frames are replaced by nz optimisations in the various sub-intervals each covering the whole of the frame. Thus nz basic delays $K_1', \ldots, K_{nz}'$ are obtained in integer resolution. The voiced/unvoiced decision (stage 92) is taken on the basis of that one of the basic delays $K_i'$ which yields the largest value for the first open-loop estimate of the long-term prediction gain. Next, if the frame is voiced, the basic delays are determined in fractional resolution by the same process as at stage 100, but allowing only the quantified values of delay. The examination 101 of the sub-multiples and of the multiples is not performed. For the phase 132 of calculation of the second estimate of the prediction gain, the nz basic delays previously determined are taken as candidate delays. This second variant makes it possible to dispense with the systematic examination of the sub-multiples and of the multiples which are, in general, taken into consideration by virtue of the subdivision of the domain of the possible delays.

According to a third variant of the open-loop LTP analysis process, the phase 132 is modified in that, at the optimisation stages 148, on the one hand, that index $i_{st}$, is determined which maximises $C_{st}^2(r_i)/G_{st}(r_i)$ for $I_{st}(j)-N1/2 \leqq i < I_{st}(j)+N1/2$ and $0 \leqq i < N$, and, on the other hand, in the course of the same maximisation loop, that index $k_{st}$ which maximises this same quantity over a reduced interval $I_{st}(j)-N3/2 \leqq i < I_{st}(j)+N3/2$ and $0 \leqq i < N$. Stage 152 is also modified: the indices ZP0 and ZP1 are no longer stored in memory, but a quantity Ymax' is, defined in the same way as Ymax but by reference to the reduced-length interval:

$$Y'_{\max} = \sum_{st'=0}^{nst-1} Y_{st'}(k_{st'})$$

In this third variant, the determination 158 of the voicing mode leads more often to the degree of voicing MV=3 being selected. Account is also taken, in addition to the previously described gain Gp, of a third open-loop estimate of the LTP gain, corresponding to Ymax': $Gp'=20\cdot\log_{10}[R0/(R0-Ymax')]$. The degree of voicing is MV=1 if $Gp \leqq S1$, MV=3 if $Gp'>S2$ and MV=2 if neither of these two conditions is satisfied. By thus increasing the proportion of frames of degree MV=3, the average complexity of the closed-loop analysis is reduced and robustness to transmission errors is enhanced.

A fourth variant of the open-loop LTP analysis process particularly concerns the slightly voiced frames (MV=1). These frames often correspond to a start or to an end of a region of voicing. Frequently, these frames may include from one to three sub-frames for which the gain coefficient of the long-term synthesis filter is zero or even negative. It is proposed not to perform the closed-loop LTP analysis for the sub-frames in question, so as to reduce the average complexity of the coding. This can be carried out by storing in memory, at stage 152 of FIG. 6, nst pointers indicating, for each sub-frame st', whether the autocorrelation $C_{st}$, corresponding to the delay of index $i_{st}$, is negative or even very small. Once all the intervals have been referenced in the lists $I_{st'}$, the sub-frames for which the prediction gain is negative or negligible can be identified by looking up the nst pointers. If appropriate, the module 38 is disabled for the corresponding sub-frames. This does not affect the quality of the LTP analysis, since the prediction gain corresponding to these sub-frames will in any event be practically zero.

Another aspect of the invention relates to the module 42 for calculating the impulse response of the weighted synthesis filter. The closed-loop LTP analysis module 38 needs this impulse response h over the duration of a sub-frame in order to calculate the convolutions $Y_T(i)$ according to formula (1). The stochastic analysis module 40 also needs it in order to calculate convolutions as will be seen later. The fact of having to calculate convolutions with a response h extending over the duration of a sub-frame (1st=40 typically) implies relative complexity of coding, which it would be desirable to reduce, particularly in order to increase the endurance of the mobile station. In certain cases, it has been proposed to truncate the impulse response to a length less than the length of a sub-frame (for example, to 20 samples), but this may degrade the quality of the coding. It is proposed, according to the invention, to truncate the impulse response h by taking account, on the one hand, of the energy distribution of this response and, on the other hand, of the degree of voicing MV of the frame in question, determined by the open-loop LTP analysis module 36.

Figure 7:
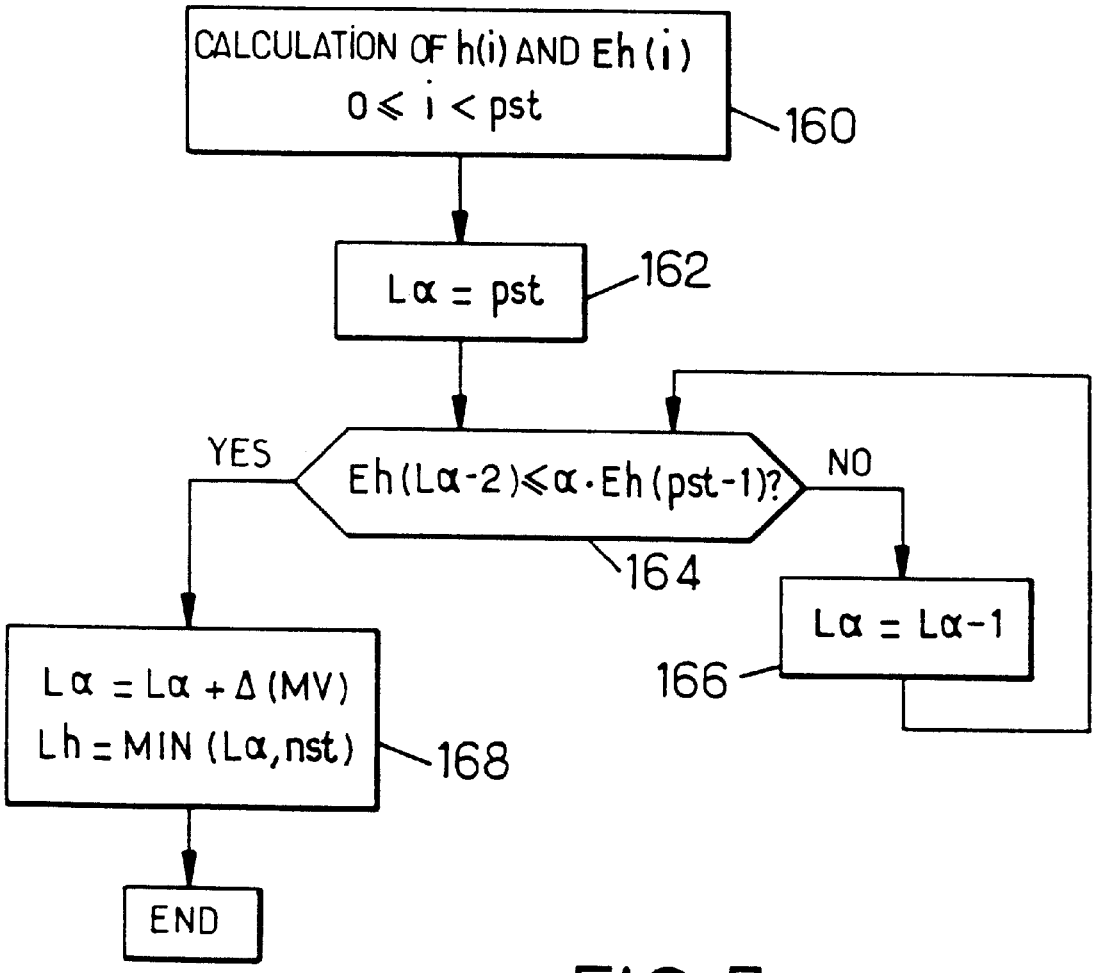
FIG. 7 is a flow chart illustrating a process for determining the impulse response of the weighted synthesis filter applied in the speech coder of FIG. 1.

The operations performed by the module 42 are, for example, in accordance with the flow chart of FIG. 7. The impulse response is first of all calculated at stage 160 over a length pst greater than the length of a sub-frame and sufficiently long to be sure of taking account of all the energy of the impulse response (for example, pst=60 for nst=4 and 1st=40 if the short-term linear prediction is of order q=10). The truncated energies of the impulse response are also calculated at stage 160:

$$Eh(i) = \sum_{k=0}^{i} [h(i)]^2$$

The components h(i) of the impulse response and the truncated energies Eh(i) may be obtained by filtering a unit pulse by means of a filter with transfer function W(z)/A(z), with zero initial states, or even by recursion, $$f(i) = \delta(i) + \sum_{k=1}^{q} a_k[\gamma_2^k \cdot f(i-k) - \gamma_1^k \cdot \delta(i-k)] \quad (2)$$

$$h(i) = f(i) + \sum_{k=1}^{q} a_k \cdot h(i-k) \quad (3)$$

$$Eh(i) = Eh(i-1) + [h(i)]^2$$

for $0<i<pst$, with $f(i)=h(i)=0$ for $i<0$, $\delta(0)=f(0)=h(0)=Eh(0)=1$ and $\delta(i)=0$ for $i \neq 0$. In expression (2), the coefficients ak are those involved in the perceptual weighting filter, that is to say the interpolated but unquantified linear prediction coefficients, while, in expression (3), the coefficients ak are those applied to the synthesis filter, that is to say the quantified and interpolated linear prediction coefficients.

Next, the module 42 determines the smallest length $L\alpha$ such that the energy $Eh(L\alpha-1)$ of the impulse response, truncated to $L\alpha$ samples, is at least equal to a proportion $\alpha$ of its total energy $Eh(pst-1)$, estimated over pst samples. A typical value of a is 98%. The number La is initialised to pst at stage 162 and decremented by one unit at 166 as long as $Eh(L\alpha-2)>\alpha\cdot Eh(pst-1)$ (test 164). The length $L\alpha$ sought is obtained when test 164 shows that $Eh(L\alpha-2) \leqq \alpha\cdot Eh(pst-1)$.

In order to take account of the degree of voicing MV, a corrector term A(MV) is added to the value of $L\alpha$ which has been obtained (stage 168). This corrector term is preferably an increasing function of the degree of voicing. For example, values may be taken such as $\Delta(0)=-5$, $\Delta(1)=0$, $\Delta(2)=+5$ and $\Delta(3)=+7$. In this way, the impulse response h will be determined in a way which is all the more precise the greater the degree of voicing of the speech. The truncation length Lh of the impulse response is taken as equal to $L\alpha$ if $L\alpha \leqq nst$ and to nst otherwise. The remaining samples of the impulse response ($h(i)=0$ with $i \geqq Lh$) can be deleted.

With the truncation of the impulse response, the calculation (1) of the convolutions $Y_T(i)$ by the closed-loop LTP analysis module 38 is modified in the following way:

$$y_T(i) = \sum_{j=\max(0,i-Lh+1)}^{i} u(j-T)\cdot h(i-j) \quad (1')$$

Obtaining these convolutions, which represents a significant part of the calculations performed, therefore requires substantially fewer multiplications, additions and addressing in the adaptive codebook when the impulse response is truncated. Dynamic truncation of the impulse response, invoking the degree of voicing MV, makes it possible to obtain such a reduction in complexity without affecting the quality of the coding. The same considerations apply for the calculations of convolutions performed by the stochastic analysis module 40. These advantages are particularly appreciable when the perceptual weighting filter has a transfer function of the form $W(z)=A(z/\gamma_1)/A(z/\gamma_2)$ with $0<\gamma_2<\gamma_1<1$ which gives rise to impulse responses which are generally longer than those of the form $W(z)=A(z)/A(z/\gamma)$ which are more usually employed in analysis-by-synthesis coders.

A third aspect of the invention relates to the stochastic analysis module 40 serving for modelling the unpredictable part of the excitation.

The stochastic excitation considered here is of the multi-pulse type. The stochastic excitation relating to a sub-frame is represented by np pulses with positions p(n) and amplitudes, or gains, g(n) ($1\leqq n\leqq np$). The long-term prediction gain $g_p$ can also be calculated in the course of the same process. In general, it can be considered that the excitation sequence relating to a sub-frame includes nc contributions associated respectively with nc gains. The contributions are 1st sample vectors which, weighted by the associated gains and summed gains, correspond to the excitation sequence of the short-term synthesis filter. One of the contributions may be predictable, or several in the case of a long-term synthesis filter with several taps ("Multi-tap pitch synthesis filter"). The other contributions, in the present case, are np vectors including only 0's except for one pulse of amplitude 1. That being so, nc=np if MV=0, and nc=np+1 if MV=1, 2 or 3.

The multi-pulse analysis including the calculation of the gain $g_p=g(0)$ consists, in a known way, in finding, for each sub-frame, positions p(n) ($1\leqq n\leqq np$) and gains g(n) ($0\leqq n\leqq np$) which minimise the perceptually weighted quadratic error E between the speech signal and the synthesised signal, given by:

$$E = \left(X - \sum_{n=0}^{nc-1} g(n)\cdot F_{p(n)}\right)^2$$

the gains being a solution of the linear system g·B=b.

In the above notations:

X designates an initial target vector composed of the 1st samples of the weighted speech signal SW without memory: X=(x(0), x(1), . . ., x(1st−1)), the x(i)'s having been calculated as indicated previously during the closed-loop LTP analysis;

g designates the row vector composed of the np+1 gains: g=(g(0)=gp, g(1), . . ., g(np));

the row vectors $F_{p(n)}$ ($0\leqq n<nc$) are weighted contributions having, as components i ($0\leqq i<1st$), the products of convolution between the contribution n to the excitation sequence and the impulse response h of the weighted synthesis filter;

b designates the row vector composed of the nc scalar products between vector X and the row vectors $F_{p(n)}$;

B designates a symmetric matrix with nc rows and nc columns, in which the term $B_{i,j}=F_{p(i)\cdot Fp(j)}{}^T$ ($0\leqq i, j<nc$) is equal to the scalar product between the previously defined vectors $F_{p(i)}$ and $F_{p(j)}$;

(·)T designates the matrix transposition.

For the pulses of the stochastic excitation ($1\leqq n<np=nc-1$) the vectors $F_{p(n)}$ consist simply of the vector of the impulse response h shifted by p(n) samples. The fact of truncating the impulse response as described above thus makes it possible substantially to reduce the number of operations of use in calculating the scalar products involving these vectors $F_{p(n)}$. For the predictable contribution of the excitation, the vector $F_{p(O)}=Y_{TP}$ has as components $F_{p(0)}(i)$ ($0\leqq i<1st$) the convolutions $Y_{TP}(i)$ which the module 38 calculated according to formula (1) or (1') for the selected long-term prediction delay TP. If MV=0, the contribution n=0 is also of pulse type and the position p(0) has to be calculated.

Minimising the quadratic error E defined above amounts to finding the set of positions p(n) which maximise the normalised correlation $b.B^{-1}\cdot b^T$ then in calculating the gains according to $g=b\cdot B^1$.

However, an exhaustive search for the pulse positions would require an excessive amount of computing. In order to reduce this problem, the multi-pulse approach generally applies a sub-optimal procedure consisting in successively calculating the gains and/or the pulse positions for each contribution. For each contribution n ($0\leqq n<nc$), first of all that position p(n) is determined which maximises the normalised correlation $(F_p\cdot e_{n-1}{}^T)^2/F_p\cdot F_p{}^T)$, the gains $g_n(0)$ to $g_n(n)$ are recalculated according to $g_n=b_n\cdot B_{n-1}$, where $g_n=(g_n(0), \ldots, g_n(n))$, $b_n=(b(0), \ldots, b(n))$ and $B_n=\{B_{i,j}\}_{0\leqq i,j\leqq n}$, then, for the following iteration, the target vector $e_n$ is calculated, equal to the initial target vector X from which are subtracted the contributions 0 to n of the weighted synthetic signal which are multiplied by their respective gains:

$$e_n = X - \sum_{i=0}^{n} g_n(i)\cdot F_p(i)$$

On completion of the last iteration nc−1, the gains $g_{nc-1}(i)$ are the selected gains and the minimised quadratic error E is equal to the energy of the target vector $e_{nc-1}$.

The above method gives satisfactory results, but it requires a matrix $B_n$ to be inverted at each iteration. In their article "Amplitude Optimisation and Pitch Prediction in Multipulse Coders" (IEEE Trans. on Acoustics, Speech and Signal Processing, Vol. 37, no. 3, March 1989, pages 317–327), S. Singhal and B. S. Atal proposed to simplify the problem of the inversion of the $B_n$ matrices by using the Cholesky decomposition: $B_n=M_n\cdot M_n{}^T$ in which $M_n$ is a lower triangular matrix. This decomposition is possible because $B_n$ is a symmetric matrix with positive eigenvalues. The advantage of this approach is that the inversion of a triangular matrix is relatively straightforward, $B_n{}^{-1}$ being obtainable by $B_n{}^{-1}=(M_n{}^{-1})^T\cdot M_n{}^{-1}$.

However, the Cholesky decomposition and the inversion of the matrix $M_n$ require divisions and square-root calculations to be performed, which are demanding operations in terms of calculating complexity. The invention proposes to simplify the implementation of the optimisation considerably by modifying the decomposition of the matrices $B_n$ in the following way:

$$B_n=L_n\cdot R_n{}^T=L_n\cdot(L_n\cdot K_n{}^{-1})^T$$

in which $K_n$ is a diagonal matrix and $L_n$ is a lower triangular matrix having only 1's on its main diagonal (i.e. $L_n=M_n\cdot K_n{}^{1/}$ 2with the preceding notation). Having regard to the structure of the matrix $B_n$, the matrices $L_n=R_n \cdot K_n$, $R_n$, $K_n$ and $L_n^{-1}$ are each constructed by simple addition of one row to the corresponding matrices of the previous iteration:

$$B_n = \begin{pmatrix} & & & B(n,0) \\ & B_{n-1} & & \vdots \\ & & & B(n,n-1) \\ B(n,0) & \dots & B(n,n-1) & B(n,n) \end{pmatrix}$$

$$L_n = \begin{pmatrix} & & & 0 \\ & L_{n-1} & & \vdots \\ & & & 0 \\ L(n,0) & \dots & L(n,n-1) & 1 \end{pmatrix}$$

$$R_n = \begin{pmatrix} & & & 0 \\ & R_{n-1} & & \vdots \\ & & & 0 \\ R(n,0) & \dots & R(n,n-1) & R(n,n) \end{pmatrix}$$

$$K_n = \begin{pmatrix} & & 0 & \\ & K_{n-1} & \vdots & \\ & & 0 & \\ 0 & \dots & 0 & K(n) \end{pmatrix}$$

$$L_n^{-1} = \begin{pmatrix} & & & 0 \\ & L_{n-1}^{-1} & & \vdots \\ & & & 0 \\ L^{-1}(n,0) & \dots & L^{-1}(n,n-1) & 1 \end{pmatrix}$$

Under these conditions, the decomposition of $B_n$, the inversion of $L_n$, the obtaining of $B_n^{-1}=K_n \cdot (L_n^{-1})^T \cdot L_n^{-1}$ and the recalculation of the gains require only a single division per iteration and no square-root calculation.

The stochastic analysis relating to a sub-frame of a voiced frame (MV=1, 2 or 3) may now proceed as indicated in FIGS. 8 to 11. To calculate the long-term prediction gain, the contribution index n is initialised to 0 at stage 180 and the vector $F_{p(0)}$ is taken as equal to the long-term contribution $Y_{TP}$ supplied by the module 38. If n>0, the iteration n commences with the determination 182 of the position p(n) of pulse n which maximises the quantity:

$$(F_p \cdot e^T)^2 / (F_p \cdot F_p^T) = \frac{\left(\sum_{k=p}^{\min(Lh+p,lst)-1} h(k-p) \cdot e(k)\right)^2}{\sum_{k=p}^{\min(Lh+p,lst)-1} h(k-p) \cdot h(k-p)}$$

in which e=(e(0), . . . , e(1st−1)) is a target vector calculated during the preceding iteration. Various constraints can be applied to the domain of maximisation of the above quantity included in the interval [0, 1st]. The invention preferably uses a segmental search in which the excitation sub-frame is subdivided into ns segments of the same length (for example, ns=10 for 1st=40). For the first pulse (n=1), the maximisation of $(F_p \cdot e^T)^2/(F_p \cdot F_p^T)$ is performed over all the possible positions p in the sub-frame. At iteration n>1, the maximisation is performed at stage 182 on all the possible positions with the exclusion of the segments in which the positions p(1), . . . , p(n−1) of the pulses were respectively found during the previous iterations.

In the case in which the current frame has been detected as unvoiced, the contribution n=0 also consists of a pulse with position p(0) . Stage 180 then comprises solely the initialisation n=0, and it is followed by a maximisation stage identical to stage 182 for finding p(0), with $e=e_{-1}=X$ as initial value of the target vector.

It will be noted that, when the contribution n=0 is predictable (MV=1, 2 or 3), the closed-loop LTP analysis module 38 has performed an operation of a type similar to the maximisation 182, since it has determined the long-term contribution, characterised by the delay TP, by maximising the quantity $(Y_T \cdot e^T)^2/(Y_T \cdot Y_T^T)$ in the delay T search interval, with $e=e_{-1}=X$ as initial value of the target vector. It is also possible, when the energy of the contribution LTP is very low, to ignore this contribution in the process of recalculating the gains.

After stage 180 or 182, the module 40 carries out the calculation 184 of the row n of the matrices L, R and K involved in the decomposition of the matrix B, which makes it possible to complete the matrices $L_n$, $R_n$ and $K_n$ defined above. The decomposition of the matrix B yields:

$$B(n,j) = R(n,j) + \sum_{k=0}^{j-1} L(n,k) \cdot R(j,k)$$

for the component situated at row n and at column j. It can n be said, for j increasing from 0 to n−1:

$$R(n,j) = B(n,j) - \sum_{k=0}^{j-1} L(n,k) \cdot R(j,k)$$

$$L(n,j) = R(n,j) \cdot K(j)$$

and, for $j = n$:

$$K(n) = 1/R(n,n) = 1 \Big/ \left[B(n,n) - \sum_{k=0}^{n-1} L(n,k) \cdot R(n,k)\right]$$

$$L(n,n) = 1$$

Figure 9:
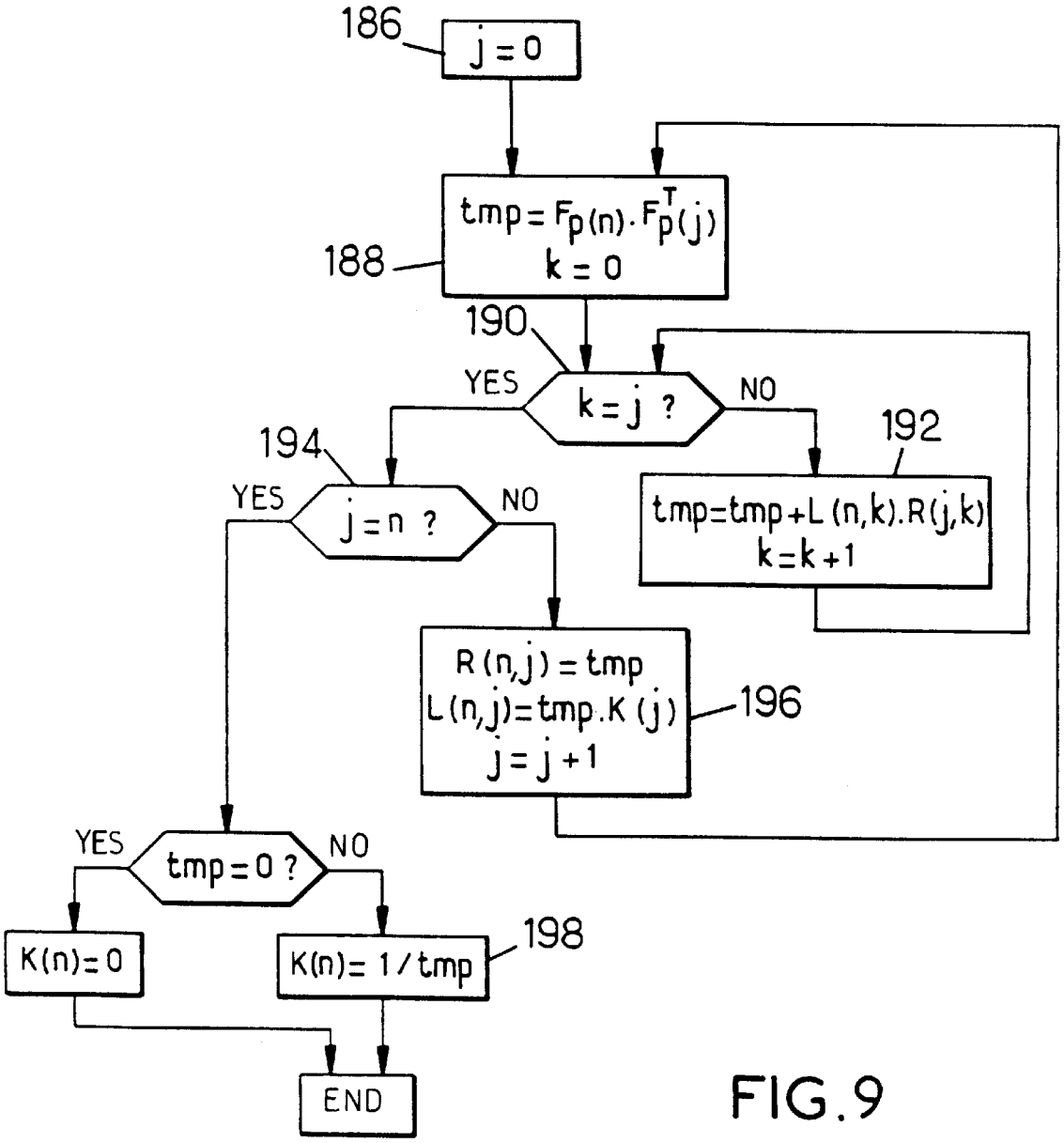

These relations are made use of in the calculation 184 detailed in FIG. 9. The column index j is firstly initialised to 0, at stage 186. For column index j, the variable tmp is firstly initialised to the value of the component B(n,j), i.e.:

$$tmp = F_{p(n)} \cdot F_{p(j)}^T = \sum_{k=\max(p(n),p(j))}^{\min(Lh+p(n),Lh+p(j),lst)-1} h(k-p(n)) \cdot h(k-p(j))$$

At stage 188, the integer k is furthermore initialised to 0. A comparison 190 is then performed between the integers k and j. If k<j, the term L(n,k)·R(j,k) is added to the variable tmp, then the integer k is incremented by one unit (stage 192) before again performing the comparison 190. When the comparison 190 shows that k=j, a comparison 194 is performed between the integers j and n. If j<n, the component R(n,j) is taken as equal to tmp and the component L(n,j) to tmp·K(j) at stage 196, then the column index j is incremented by one unit before returning to stage 188 in order to calculate the following components. When the comparison 194 shows that j=n, the component K(n) of row n of the matrix K is calculated, which terminates the calculation 184 relating to row n. K(n) is taken as equal to 1/tmp if tmp ≠ 0 (stage 198) and to 0 otherwise. It will be noted that the calculation 184 requires only one division 198 at most in order to obtain K(n). Moreover, any singularity of the matrix $B_n$ does not entail instabilities since divisions by 0 are avoided.

Figure 8:
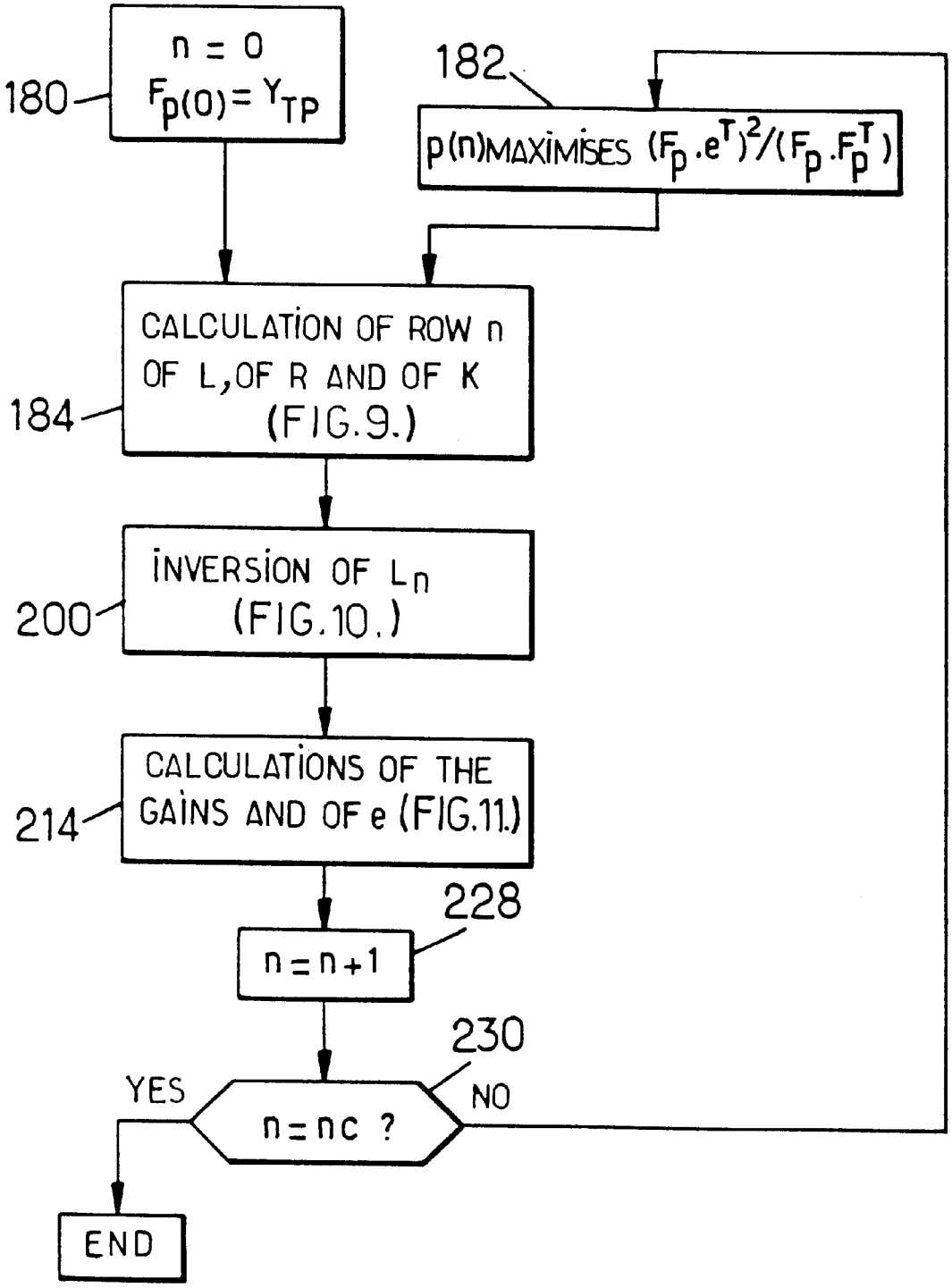
FIGS. 8 to 11 are flow charts illustrating a process of searching for the stochastic excitation applied in the speech coder of FIG. 1.
Figure 10:
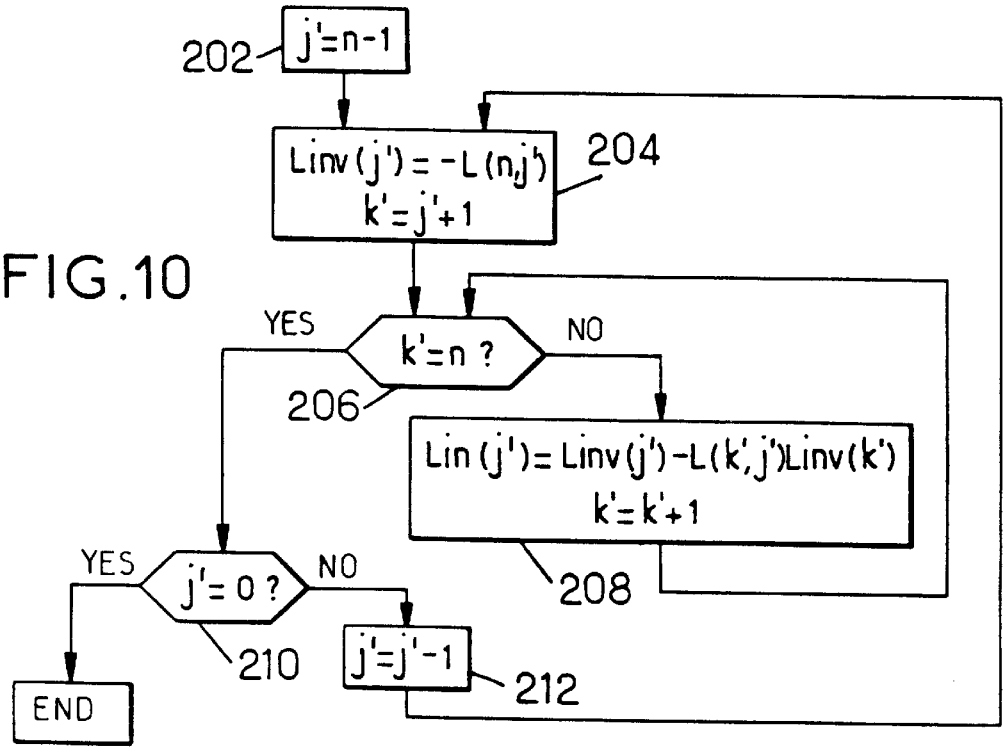
Figure 11:
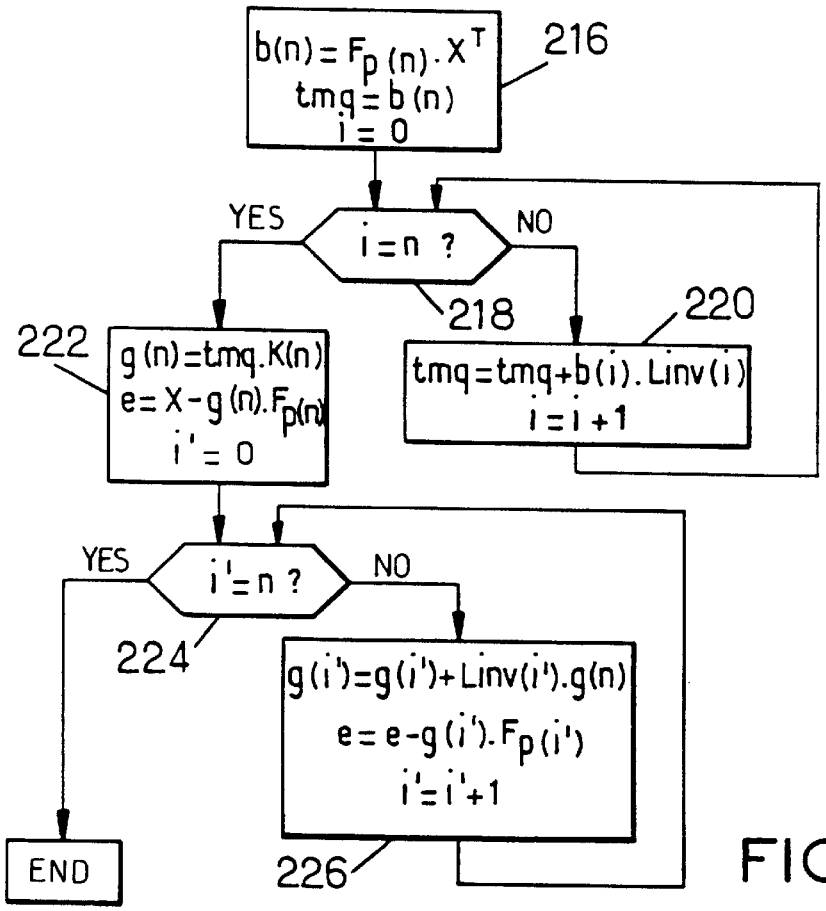

By reference to FIG. 8, the calculation 184 of the rows n of L, R and K is followed by the inversion 200 of the matrix $L_n$ consisting of the rows and of the columns 0 to n of the matrix L. The fact that L is triangular with 1's on its principal diagonal greatly simplifies the inversion thereof as FIG. 10 shows. Indeed, it can be stated that:

$$L^{-1}(n,j') = -L(n,j') - \sum_{k'=j'+1}^{n} L^{-1}(k',j') \cdot L(n,k') \quad (4)$$

-continued $$= -L(n, j') - \sum_{k'=j'+1}^{n} L(k', j') \cdot L^{-1}(n, k') \quad (5)$$

for $0 \leqq j' < n$ and $L^{-1}(n,n)=1$, that is to say that the inversion can be done without having to perform a division. Moreover, as the components of row n of $L^{-1}$ suffice for recalculating the gains, the use of the relation (5) makes it possible to carry out the inversion without having to store the whole matrix $L^{-1}$, but only one vector Linv=(Linv(0), . . . , Linv(n−1)) with $Linv(j')=L^{-1}(n, j')$. The inversion 200 then commences with initialisation 202 of the column index j' to n−1. At stage 204, the term Linv(j') is initialised to −L(n, j') and the integer k' to j'+1. Next a comparison 206 is performed between the integers k' and n. If k'<n, the term L(k',j').Linv(k') is subtracted from Linv(j'), then the integer k' is incremented by one unit (stage 208) before again performing the comparison 206. When the comparison 206 shows that k'=n, j' is compared to 0 (test 210). If j'>0 the integer j' is decremented by one unit (stage 212) and stage 204 is re-entered for calculating the following component. The inversion 200 is terminated when test 210 shows that j'=0.

Referring to FIG. 8, the inversion 200 is followed by the calculation 214 of the re-optimised gains and of the target vector E for the following iteration. The calculation of the re-optimised gains is also very much simplified by the decomposition adopted for the matrix B. This is because it is possible to calculate the vector $g_n=(g_n(0), \ldots, g_n(n))$, the solution of $g_n \cdot B_n = b_n$ according to:

$$g_n(n) = \left[ b(n) + \sum_{i=0}^{n-1} b(i) \cdot L^{-1}(n, i) \right] \cdot K(n)$$

and $g_n(i')\ g_{n-1}(i') + L^{-1}(n,i') \cdot g_n(n)$ for $0 \leqq i' < n$. The calculation 214 is detailed in FIG. 11. Firstly, the component b(n) of the vector b is calculated:

$$b(n) = F_{p(n)} \cdot X^T = \sum_{k=p(n)}^{\min(Lh+p(n),lst)-1} h(k - p(n)) \cdot x(k)$$

b(n) serves as initialisation value for the variable tmq. At stage 216, the index i is also initialised to 0. Next the comparison 218 is performed between the integers i and n. If i<n, the term b(i).Linv(i) is added to the variable tmq and i is incremented by one unit (stage 220) before returning to the comparison 218. When the comparison 218 shows that i=n, the gain relating to the contribution n is calculated according to g(n)=tmq·K(n), and the loop for calculating the other gains and the target vector is initialised (stage 222), taking $e=X-g(n) \cdot F_p(n)$ and i'=0. This loop comprises a comparison 224 between the integers i' and n. If i'<n, the gain g(i') is recalculated at stage 226 by adding Linv(i').g(n) to its value calculated at the preceding iteration n−1, then the vector $g(i') \cdot F_{p(i')}$ is subtracted from the target vector e. Stage 226 also comprises the incrementation of the index i' before returning to the comparison 224. The calculation 214 of the gains and of the target vector is terminated when the comparison 224 shows that i'=n. It can be seen that it has been possible to update the gains while calling on only row n of the inverse matrix $L_n^{-1}$.

The calculation 214 is followed by incrementation 228 of the index n of the contribution, then by a comparison 230 between the index n and the number of contributions nc. If n<nc, stage 182 is re-entered for the following iteration. The optimisation of the positions and of the gains is terminated when n=nc at test 230.

The segmental search for the pulses substantially reduces the number of pulse positions to be evaluated in the course of the stochastic excitation search stages 182. It moreover allows effective quantification of the positions found. In the typical case in which the sub-frame of 1st=40 samples is divided into ns=10 segments of 1s=4 samples, the set of possible pulse positions may take $ns! \cdot 1s^{np}/[np!(ns-np)!]$= 258,048 values if np=5 (MV=1, 2 or 3) or 860,160 if np=6 (MV=0), instead of 1st!/[np!(1st-np)!]=658,008 values if np=5, or 3,838,380 if np=6 in the case in which it is specified only that two pulses may not have the same position. In other words, the positions can be quantified over 18 bits instead of 20 bits if np=5, and over 20 bits instead of 22 if np=6.

The particular case in which the number of segments per sub-frame is equal to the number of pulses per stochastic excitation (ns=np) leads to the greatest simplicity in the search for the stochastic excitation, as well as to the lowest binary data rate (if 1st=40 and np=5, there are $8^5$=32768 sets of possible positions, quantifiable over only 15 bits instead of 18 if ns=10). However, by reducing the number of possible innovation sequences to this point, the quality of the coding may be impoverished. For a given number of pulses, the number of segments may be optimised according to a compromise envisaged between the quality of the coding and the simplicity of implementing it (as well as the required data rate).

The case in which ns>np additionally exhibits the advantage that good robustness to transmission errors can be obtained, as far as the pulse positions are concerned, by virtue of a separate quantification of the order numbers of the occupied segments and of the relative positions of the pulses in each occupied segment. For a pulse n, the order number $s_n$ of the segment and the relative position prn are respectively the quotient and the remainder of the Euclidean division of p(n) by the length 1s of a segment: $p(n)=s_n \cdot 1s + pr_n$ ($0 \leqq s_n < ns$, $0 \leqq pr_n < 1s$). The relative positions are each quantified separately on 2 bits, if 1s=4. In the event of a transmission error affecting one of these bits, the corresponding pulse will be only slightly displaced, and the perceptual impact of the error will be limited. The order numbers of the occupied segments are identified by a binary word of ns=10 bits each equal to 1 for the occupied segments and 0 for the segments in which the stochastic excitation has no pulse. The possible binary words are those having a Hamming weight of np; they number ns!/[np!(ns-np)!]=252 if np=5, or 210 if np=6. This word can be quantified by an index of nb bits with $2^{nb-1} < ns!/[np!(ns-np)!] \leqq 2^{nb}$, i.e. nb=8 in the example in question. If, for example, the stochastic analysis has supplied np=5 pulses with positions 4, 12, 21, 34, 38, the relative positions, quantified as scalars, are 0, 0, 1, 2, 2 and the binary word representing the occupied segments is 0101010011, or 339 when translated into decimal.

As for the decoder, the possible binary words are stored in a quantification table in which the read addresses are the received quantification indices. The order in this table, determined once and for all, may be optimised so that a transmission error affecting one bit of the index (the most frequent error case, particularly when interleaving is employed in the channel coder 22) has, on average, minimal consequences according to a proximity criterion. The proximity criterion is, for example, that a word of ns bits can be replaced only by "adjacent" bits, separated by a Hamming distance equal at most to a threshold np-2δ, so as to preserve all the pulses except δ of them at valid positions in the event of an error in transmission of the index affecting a single bit. Other criteria could be used in substitution or in supplement, for example that two words are considered to be adjacent if the replacement of one by the not alter the order of assignment of the gains with the pulses.

By way of illustration, the simplified case can be considered where ns=4 and np=2, i.e. 6 possible binary words quantifiable over nb=3 bits. In this case, it can be verified that the quantification table presented in table II allows np−1=1 correctly positioned pulse to be kept for every error affecting one bit of the index transmitted. There are 4 error cases (out of a total of 18), for which a quantification index known to be erroneous is received (6 instead of 2 or 4; 7 instead of 3 or 5), but the decoder can then takes measures limiting the distortion, for example can repeat the innovation sequence relating to the preceding sub-frame, or even assign acceptable binary words to the "impossible" indices (for example, 1001 or 1010 for the index 6 and 1100 or 0110 for the index 7 lead again to np−1=1 correctly positioned pulse in the event of reception of 6 or 7 with a binary error).

TABLE II

| quantification index | | segment occupation word | |
|---|---|---|---|
| decimal | natural binary | natural binary | decimal |
| 0 | 000 | 0011 | 3 |
| 1 | 001 | 0101 | 5 |
| 2 | 010 | 1001 | 9 |
| 3 | 011 | 1100 | 12 |
| 4 | 100 | 1010 | 10 |
| 5 | 101 | 0110 | 0 |
| (6) | (110) | (1001 or 1010) | (9 or 10) |
| (7) | (111) | (1100 or 0110) | (12 or 6) |

In the general case, the order of the words in the quantification table can be determined on the basis of arithmetic considerations or, if that is insufficient, by simulating the error scenarios on the computer (exhaustively or by a statistical sampling of the Monte Carlo type depending on the number of possible error cases).

In order to make transmission of the occupied segment quantification index more secure, advantage can be taken, furthermore, of the various categories of protection offered by the channel coder 22, particularly if the proximity criterion cannot be met satisfactorily for all the possible error cases affecting one bit of the index. The ordering module 46 can thus place in the minimum protection category, or the unprotected category, a certain number nx of bits of the index which, if they are affected by a transmission error, give rise to a word which is erroneous but which satisfies the proximity criterion with a probability deemed to be satisfactory, and place the other bits of the index in a better protected category. This approach involves another ordering of the words in the quantification table. This ordering can also be optimised by means of simulations if it is desired to maximise the number nx of bits of the index assigned to the least protected category.

One possibility is to start by compiling a list of words of ns bits by counting in Gray code from 0 to $2^{ns}-1$, and to obtain the ordered quantification table by deleting from that list the words not having a Hamming weight of np. The table thus obtained is such that two consecutive words have a Hamming distance of np−2. If the indices in this table have a binary representation in Gray code, any error in the least-significant bit causes the index to vary by ±1 and thus entails the replacement of the actual occupation word by a word which is adjacent in the meaning of the threshold np−2 over the Hamming distance, and an error in the i-th least-significant bit also causes the index to vary by +1 with a probability of about $2^{1-i}$. By placing the nx least-significant bits of the index in Gray code in an unprotected category, any transmission error affecting one of these bits leads to the occupation word being replaced by an adjacent word with a probability at least equal to $(1+1/2+\ldots+1/2^{nx-1})/nx$. This minimal probability decreases from 1 to $(2/nb)(1-1/2^{nb})$ for nx increasing from 1 to nb. The errors affecting the nb-nx most significant bits of the index will most often be corrected by virtue of the protection which the channel coder applies to them. The value of nx in this case is chosen as a compromise between robustness to errors (small values) and restricted size of the protected categories (large values).

As for the coder, the binary words which are possible for representing the occupation of the segments are held in increasing order in a lookup table. An indexing table associates the order number, at each address, in the quantification table stored at the decoder, of the binary word having this address in the lookup table. In the simplified example set out above, the contents of the lookup table and of the indexing table are given in table III (in decimal values).

The quantification of the segment occupation word deduced from the np positions supplied by the stochastic analysis module 40 is performed in two stages by the quantification module 44. A binary search is performed first of all in the lookup table in order to determine the address in this table of the word to be quantified. The quantification index is then obtained at the defined address in the indexing table then supplied to the bit ordering module 46.

TABLE III

| Address | Lookup table | Indexing table |
|---|---|---|
| 0 | 3 | 0 |
| 1 | 5 | 1 |
| 2 | 6 | 5 |
| 3 | 9 | 2 |
| 4 | 10 | 4 |
| 5 | 12 | 3 |

The module 44 furthermore performs the quantification of the gains calculated by the module 40. The gain $g_{TP}$ is quantified, for example, in the interval [0, 1.6], over 5 bits if MV=1 or 2 and over 6 bits if MV=3 in order to take account of the higher perceptual importance of this parameter for the very voiced frames. For coding of the gains associated with the pulses of the stochastic excitation, the largest absolute value Gs of the gains g(1), . . . , g(np) is quantified over five bits, taking, for example, 32 values of quantification in geometric progression in the interval [0, 32767], and each of the relative gains g(1)/Gs, . . . , g(np)/Gs is quantified in the interval [−1,+1], over 4 bits if MV=1, 2 or 3, or over five bits if MV=0.

The quantification bits of Gs are placed in a protected category by the channel coder 22, as are the most significant bits of the quantification indices of the relative gains. The quantification bits of the relative gains are ordered in such a way as to allow them to be assigned to the associated pulses belonging to the segments located by the occupation word. The segmental search according to the invention further makes it possible effectively to protect the relative positions of the pulses associated with the highest values of gain.

In the case where np=5 and 1s=4, ten bits per sub-frame are necessary to quantify the relative positions of the pulses in the segments. The case is considered in which 5 of these 10 bits are placed in a partly protected or unprotected category (II), and in which the other 5 are placed in a more highly protected category (IB). The most natural distribution is to place the most significant bit of each relative position in the protected category IB, so that any transmission errors tend to affect the most significant bits and therefore cause only a shift of one sample for the corresponding pulse. It is advisable, however, for the quantification of the relative positions, to consider the pulses in decreasing order of absolute values of the associated gains, and to place in category IB the two quantification bits of each of the first two relative positions as well as the most significant bit of the third one. In this way, the positions of the pulses are protected preferentially when they are associated with high gains, which enhances average quality, particularly for the most voiced sub-frames.

In order to reconstitute the pulse contributions of the excitation, the decoder 54 firstly locates the segments by means of the received occupation word; it then assigns the associated gains; then it assigns the relative positions to the pulses on the basis of the order of size of the gains.

It will be understood that the various aspects of the invention described above each yield specific improvements, and that it is therefore possible to envisage implementing them independently of one another. Combining them makes it possible to produce a coder of particularly beneficial performance.

In the illustrative embodiment described in the foregoing, the 13 kbits/s speech coder requires of the order of 15 million instructions per second (Mips) in fixed point mode. It will therefore typically be produced by programming a commercially available digital signal processor (DSP), and likewise for the decoder which requires only of the order of 5 Mips.

I claim:

1. An analysis-by-synthesis speech coding method, comprising:

a) obtaining a digital speech signal from a speech signal source;

b) formatting the speech signal into a plurality of successive frames, wherein each frame is divided into sub-frames and wherein each sub-frame includes a plurality of samples, the plurality of samples having a number of samples 1st;

c) performing a linear prediction analysis for each frame of the speech signal to determine coefficients for a short-term synthesis filter;

d) determining for each sub-frame a composite excitation sequence, wherein each composite excitation sequence is a linear combination of a plurality of contributions, the plurality of contributions having a number of contributions nc, wherein each contribution is weighted by a respective gain in the combination, and wherein each of the contributions comprises a vector of 1st components whereby the composite excitation sequence submitted to the short-term synthesis filter produces a synthetic signal representative of the digital speech signal; and e) outputting encoded quantities representing (i) the coefficients of the short-term synthesis filter, (ii) the contributions, and (iii) the gains weighting the contributions, the gains weighting the contributions being $g_{nc-1}$;

wherein determining the composite excitation for each sub-frame comprises an iterative process, the iterative process including selecting an initial target vector X and the iterative process having nc iterations;

wherein each iteration n ($0 \leqq n < nc$) of the iterative process includes:

i) determining a contribution c(n) based on a quantity of a form $(F_p \cdot e_{n-1}^T)^2/(F_P \cdot F_P^T)$, wherein F, designates a row vector of 1st components equal to a product of convolution between one of a plurality of contribution values and an impulse response of a composite filter, the composite filter consisting of the short-term synthesis filter and a perceptual weighting filter, wherein $e_{n-1}$, designates an n-th target vector of 1st components, with $e_{-1}=X$ being the initial target vector for n=0, and wherein the determination includes selecting as c(n) a contribution value such that the quantity is maximum;

ii) calculating n+1 gains forming a row vector $g_n=(g_n(0), \ldots, g_n(n))$ by solving the linear system $g_n \cdot B_n = b_n$, wherein $B_n$ is a symmetric matrix with n+1 rows and n+1 columns, wherein the component $B_n(i,j)$ ($0 \leqq i \leqq n$ and $0 \leqq j \leqq n$) is equal to a scalar product $F_{p(i)} \cdot F_{p(j)}^T$, wherein $F_{p(i)}$ and $F_{p(j)}$ respectively designate row vectors equal to the products of convolution between the contributions c(i) and c(j), as determined in determining the contribution of iterations i and j, respectively, and the impulse response of the composite filter, and $b_n$ is a row vector with n+1 components $b_n(i)$ ($0 \leqq i \leqq n$) respectively equal to scalar products between the vectors $F_{p(j)}$ and the initial target vector X;

wherein solving the linear system $g_n \cdot B_n = b_n$ in the iteration n ($0 \leqq n < nc$) of the iterative process for each sub-frame comprises:

1) calculating rows n of three respective matrices L, R, and K, each matrix having nc rows and nc columns, such that $B_n = L_n \cdot R_n^T$ and $L_n = R_n \cdot K_n$ where $L_n$, $R_n$, and $K_n$ designate matrices with n+1 rows and n+1 columns corresponding respectively to the first n+1 rows and to the first n+1 columns of the matrices L, R, and K, the matrices L and R being lower triangular matrices the matrix K being diagonal and the matrix L having only values of 1 on a main diagonal thereof;

2) calculating row n of the matrix $L^{-1}$, wherein matrix $L^{-1}$ is an inverse matrix of the matrix L; and 3) obtaining the n+1 gains according to the relation $g_n = b_n \cdot K_n \cdot (L_n^{-1}) \cdot L_n^{-1}$, wherein $L_n^{-1}$ designates a matrix with n+1 rows and n+1 columns corresponding respectively to the first n+1 rows and to the first n+1 columns of the inverse matrix $L_n^{-1}$ and iii) determining the n-th target vector $e_n$ as $$e_n = X - \sum_{i=0}^{n} g_n(i) \cdot F_{p(i)};$$

wherein the nc gains associated with the nc contributions of the excitation sequence are calculated during the iteration nc−1 of the iterative process.

2. The method of claim 1 wherein calculating the rows n of the matrices L, R, and K in each iteration n ($0 \leqq n < nc$) of the iterative process comprises successively calculating, for j increasing from 0 to n−1, terms R(n,j) and L(n,j), the terms situated respectively at row n and at column j of the matrices R and L, wherein:

$$R(n, j) = B(n, j) - \sum_{k=0}^{j-1} L(n, k) \cdot R(j, k)$$

$$L(n, j) = R(n, j) \cdot K(j);$$

and then calculating the term K(n) situated at row n and at column n of the matrix K, wherein:

$$K(n) = 1 \Big/ \left[ B(n,n) - \sum_{k=0}^{n-1} L(n,k) \cdot R(n,k) \right]$$

$$\text{or } K(n) = 0 \text{ if } B(n,n) - \sum_{k=0}^{n-1} L(n,k) \cdot R(n,k) = 0.$$

3. The method of claim 2 wherein calculating the row n of the matrix $L^{-1}$ in each iteration n ($0 \leqq n < nc$) of the iterative process comprises successively calculating, for j' decreasing from n−1 to 0, terms $L^{-1}(n, j')$, wherein the terms $L^{-1}(n, j')$ are situated respectively at row n and at the columns j'of the inverse matrix $L^{-1}$, wherein:

$$L^{-1}(n, j') = -L(n, j') - \sum_{k'=j'+1}^{n} L^{-1}(k', j') \cdot L(n, k')$$

$$\text{or } L^{-1}(n, j') = -L(n, j') - \sum_{k'=j'+1}^{n} L(k', j') \cdot L^{-1}(n, k).$$

4. The method of claim 3 wherein obtaining the n+1 gains in each iteration n ($0 \leqq n < nc$) of the iterative process comprises calculating the gain g(n), wherein:

$$g_n(n) = \left[ b(n) + \sum_{i=0}^{n-1} b(i) \cdot L^{-1}(n, i) \right] \cdot K(n);$$

and then calculating the gains $g_n(i')$ for i' lying between 0 and n−1, wherein:

$$g_n(i') = g_{n-1}(i') + L^{-1}(n, i') \cdot g_n(n).$$

5. The method of claim 1 wherein the nc contributions comprise at least one long-term contribution corresponding to a delayed past excitation.

6. The method of claim 1 wherein the excitation sequence includes a stochastic excitation, the stochastic excitation including a number of pulses np, the pulses having respective positions in the sub-frame and being associated with respective gains, the respective positions of the pulses in the sub-frame and the respectively associated gains being calculated, wherein each sub-frame is subdivided into ns segments, ns being a number at least equal to the number np of pulses per stochastic excitation, wherein the positions of the pulses of the stochastic excitation relating to each sub-frame are determined successively, and wherein a first pulse of the pulses is sought at any position in the sub-frame and the pulses following the first pulse are sought at any position in the sub-frame while excluding each segment including the portion of a pulse that has previously been determined.

7. The method of claim 6 wherein the number ns of segments per sub-frame is greater than the number np of pulses per stochastic excitation, and wherein outputting encoded quantities comprises quantifying in distinct ways order numbers of the segments occupied by the pulses of the stochastic excitation and relative positions of the pulses in the occupied segments.

8. The method of claim 7 wherein occupation of the segments is represented by a word of ns bits, the bits at 1 having the same order number as the occupied segments, the occupation words being ordered in a quantification table indexed by indices of nb bits, with $2^{nb-1} < ns!/[np!(ns-np)!] \leqq 2^{nb}$, such that two words having indices in binary representation that differ by a single bit are adjacent according to a predetermined criterion, and wherein outputting encoded quantities further comprises:

outputting, for each sub-frame, the index in the quantification table of the occupation word corresponding to the np pulses of the stochastic excitation.

9. The method of claim 7 wherein the occupation of the segments is represented by a word of ns bits, wherein the bits at 1 have the same order number as the occupied segments, the occupation words being ordered in a quantification table indexed by indices of nb bits, with $2^{nb-1} < ns!/[np!(ns-np)!] \leqq 2^{nb}$, such that two words having respective indices in binary representation that differ by a single bit forming part of nx bits of defined significance are adjacent according to a predetermined criterion, and wherein outputting encoded quantities further comprises, for each sub-frame:

outputting the index in the quantification table of the occupation word corresponding to the np pulses of the stochastic excitation; and selectively protecting against transmission errors the nb-nx bits of the index other than the nx bits of defined significance.

10. The method of claim 7 wherein an open-loop analysis of the speech signal is performed to detect voiced frames of the signal, further comprising for the sub-frames of the voiced frames, providing a first number of pulses per stochastic excitation and a first quantification table for the segment occupation words; and for the sub-frames of the unvoiced frames, providing a second number of pulses per stochastic excitation and a second quantification table for the segment occupation words.

11. The method of claim 7 wherein bits for quantification of the relative positions of the np pulses are distributed between a first group which is protected against transmission errors and a second less-protected group, the distribution being based on the size of the gains associated with the contributions comprised of the pulses.

12. The method of claim 11 wherein at least one pulse having a high relative gain in absolute value has a greater number of bits for quantification of relative position in the first group than pulses having a lower relative gain in absolute value.

13. An analysis-by-synthesis speech coder, comprising:

a) means for obtaining a digital speech signal from a speech signal source, the digital speech signal in the form of successive frames divided into sub-frames, each sub-frame having a number of samples 1st;

b) linear prediction means for determining coefficients of a short-term synthesis filter from a linear prediction analysis of each frame of the speech signal;

c) excitation determination means for determining for each sub-frame a composite excitation sequence as a linear combination of a number nc of contributions, wherein each contribution is weighted by a respective gain in the combination, wherein each of the contributions comprises a vector of 1st components, whereby the composite excitation sequence submitted to the short-term synthesis filter produces a synthetic signal representative of the speech signal; and d) output means for outputting encoded quantities representing (i) the coefficients of the short-term synthesis filter, (ii) the contributions, and (iii) the gains weighting the contributions; the gains weighting the contributions being $g_{nc-1}$;

wherein the excitation determination means are arranged to carry out, for each sub-frame, an iterative process, the iterative process including selecting an initial target vector X and nc iterations, wherein the iteration n ($0 \leqq n < nc$) of the iterative process includes:

i) determining a contribution c(n) based on a quantity of the form $(F_p \cdot e_{n-}{}^T)^2/(F_p \cdot F_p{}^T)$, wherein $F_p$ designates a row vector of 1st components equal to a product of convolution between one of a plurality of contribution values and an impulse response of a composite filter, the composite filter consisting of the short-term synthesis filter and a perceptual weighting filter, wherein $e_{n-1}$ designates an n-th target vector of 1st components, with $e_{-1}=X$ being the initial target vector for n=0, and wherein determining includes selecting as c(n) a contribution value such that the quantity is maximum;

ii) calculating n+1 gains forming a row vector $g_n=(g_n(0), \ldots, g_n(n))$ by solving the linear system $g_n \cdot B_n=b_n$, wherein $B_n$ is a symmetric matrix with n+1 rows and n+1 columns, wherein the component $B_n(i,j)$ ($0 \leqq i \leqq n$ and $0 \leqq i \leqq n$) is equal to the scalar product $F_{p(i)} \cdot F_{p(j)}^T$, wherein $F_{P(j)}$ and $F_{P(j)}$ respectively designate row vectors equal to the products of convolution between the contributions c(i) and c(j) respectively determined by the contribution determining of iterations i and j and the impulse response of the composite filter, and $b_n$ is a row vector with n+1 components $b_n(i)$ ($0 \leqq i \leqq n$) respectively equal to the scalar products between the vectors $F_{p(j)}$ and the initial target vector X;

wherein the excitation determination means are arranged to carry out solving of the linear system $g_n \cdot B_n=b_n$ in iteration n ($0 \leqq n<nc$) of the iterative process for each sub-frame, the excitation determination including:

1) calculating rows n of three respective matrices L, R, and K, each matrix having nc rows and nc columns, such that $B_n=L_n \cdot R_n^T$ and $L_n=R_n \cdot K_n$, where $L_n$, $R_n$ and $K_n$ designate matrices with n+1 rows and n+1 columns corresponding respectively to the first n+1 rows and to the first n+1 columns of the matrices L, R, and K the matrices L and R being lower triangular matrices, the matrix K being diagonal, and the matrix L having only values of 1 on a main diagonal thereof, 2) calculating row n of the matrix $L^{-1}$, wherein $L^{-1}$ is an inverse matrix of the matrix L: and 3) obtaining the n+1 gains according to the relation $g_n=b_n \cdot K_n \cdot (L_n^{-1})^T \cdot L_n^{-1}$, wherein $L_n^{-1}$ designates a matrix with n+1 rows and n+1 columns corresponding respectively to the first n+1 rows and to the first n+1 columns of the inverse matrix $L_n^{-1}$; and iii! determining the n-th target vector $e_n$ as $$e_n = X - \sum_{i=0}^{n} g_n(i) \cdot F_{p(i)}$$

wherein the nc gains associated with the nc contributions of the excitation sequence are those calculated during the iteration nc-1 of the iterative process.

14. The coder of claim 13 wherein the excitation determination means are arranged to carry out, in the calculation of rows n of the matrices L, R, and K in each iteration n ($0 \leqq n<nc$) of the iterative process, successive calculations, for j increasing from 0 to n−1, of the terms R(n, j) and L(n, j), the terms situated respectively at row n and at column j of the matrices R and L, wherein:

$$R(n, j) = B(n, j) - \sum_{k=0}^{j-1} L(n, k) \cdot R(j, k)$$

$$L(n, j) = R(n, j) \cdot K(j);$$

and calculating means for the term K(n) situated at row n and at column n of the matrix K, wherein:

$$K(n) = 1 \Big/ \left[ B(n, n) - \sum_{k=0}^{n-1} L(n, k) \cdot R(n, k) \right]$$

$$\text{or } K(n) = 0 \text{ if } B(n, n) - \sum_{k=0}^{n-1} L(n, k) \cdot R(n, k) = 0.$$

15. The coder of claim 26 wherein the excitation determination means are arranged to carry out, in the calculation of row n ofthe matrix $L^{-1}$ in each iteration n ($0<n<nc$) of the iterative process, successive calculations, for j' decreasing from n−1 to 0, wherein the terms $L^{-1}(n,j')$ are situated respectively at row n and at the columns j' of the inverse matrix L¯1, wherein:

$$L^{-1}(n, j') = -L(n, j') - \sum_{k'=j'+1}^{n} L^{-1}(k', j') \cdot L(n, k')$$

$$\text{or } L^{-1}(n, j') = -L(n, j') - \sum_{k'=j'+1}^{n} L(k', j') \cdot L^{-1}(n, k').$$

16. The coder of claim 15 wherein the excitation determination means are arranged to carry out, within obtaining the n+1 gains in each iteration n ($0 \leqq n<nc$) of the iterative process, the calculation of the gain $g_n(n)$, wherein:

$$g_n(n) = \left[ b(n) + \sum_{i=0}^{n-1} b(i) \cdot L^{-1}(n, i) \right] \cdot K(n);$$

and calculating means for the gains $g_n(i')$ for i' lying between 0 and n−1, wherein:

$$g_n(i')=g_{n-1}(i')+L^{-1}(n,i') \cdot g_n(n).$$

17. The coder of claim 13 wherein the nc contributions comprise at least one long-term contribution corresponding to a delayed past excitation.

18. The coder of claim 13 wherein the excitation sequence includes a stochastic excitation, the stochastic excitation including a number np of pulses, the respective positions of the pulses in the sub-frame and respectively associated gains being calculated by the excitation determination means, wherein each sub-frame is subdivided into ns segments, ns being a number at least equal to the number np of pulses per stochastic excitation, wherein the positions of the pulses of the stochastic excitation relating to a sub-frame are determined successively, and wherein a first pulse is sought at any position in the sub-frame and the pulses following the first pulse are sought at any position in the sub-frame while excluding each segment including the position of a pulse that has previously been determined.

19. The coder of claim 18 wherein the number ns of segments per sub-frame is greater than the number np of pulses per stochastic excitation, and wherein the output means includes means for quantifying in distinct ways order numbers of the segments occupied by the pulses of the stochastic excitation and relative positions of the pulses in the occupied segments.

20. The coder of claim 19 wherein the occupation of the segments is represented by a word of ns bits, the bits at 1 having the same order number as the occupied segments, and wherein the means for quantifying include:

a quantification table indexed by indices of nb bits, with $2^{nb-1}<ns! / [np! (ns-np)!] \leqq 2^{nb}$, wherein the occupation words are ordered such that two words having respective indices in binary representation that differ by a single bit are adjacent according to a predetermined criterion; and means for outputting, for each sub-frame, the index in the quantification table of the occupation word corresponding to the np pulses of the stochastic excitation.

21. The coder of claim 19 wherein the occupation of the segments is represented by a word of ns bits, the bits at 1 having the same order number as the occupied segments, and wherein the means for quantifying include:

a quantification table indexed by indices of nb bits, with $2^{nbl-1}$<ns! / [np! (ns-np)!]≦$2^{nb}$, wherein the occupation words are ordered in the quantification table such that two words having respective indices in binary representation that differ by a single bit forming part of nx bits of defined significance are adjacent according to a predetermined criterion;

means for outputting, for each sub-frame, the index in the quantification table of the occupation word corresponding to the np pulses of the stochastic excitation; and means for selectively protecting against transmission errors the nb-nx bits of the index other than said nx bits of defined significance.

22. The coder of claim 19 further comprising openloop analysis means for performing an open-loop analysis of the speech signal to detect voiced frames of the signal, wherein, for the sub-frames of the voiced frames, a first number of pulses per stochastic excitation and a first quantification table for the segment occupation words are provided, and wherein, for the sub-frames of the unvoiced frames, a second number of pulses per stochastic excitation and a second quantification table for the segment occupation words are provided.

23. The coder of claim 19 wherein the output means comprises means for distributing bits for quantification of the relative positions of the np pulses between a first group that is protected against transmission errors and a second less protected group, the distribution being based on the size of the gains associated with the contributions comprised of the pulses.

24. The coder of claim 23 wherein at least one pulse having a high relative gain in absolute value has a greater number of bits for quantification of relative position in the first group than pulses having a lower relative gain in absolute value.

* * * * *

UNITED STATES PATENT AND TRADEMARK OFFICE

CERTIFICATE OF CORRECTION

PATENT NO. : 5,899,968

DATED : May 4, 1999

INVENTOR(S) : William Navarro, et. al.

It is certified that error appears in the above-identified patent and that said Letters Patent is hereby corrected as shown below:

Column 23, line 67, replace "wherein F, designates" with --wherein $F_P$ designates--.

Signed and Sealed this

Fifth Day of December, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,899,968

DATED : May 4, 1999

INVENTOR(S) : William Navarro, et. al.

It is certified that error appears in the above-indentified patent and that said Letters Patent is hereby corrected as shown below:

Title page, item [73] Assignee: should read --Matra Communication--.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*